US008231371B1

(12) United States Patent
Jalbert

(10) Patent No.: US 8,231,371 B1
(45) Date of Patent: Jul. 31, 2012

(54) APPARATUS AND METHODS FOR BUILDING AND DRYWALL TOOLS

(75) Inventor: David Brian Jalbert, Coventry, RI (US)

(73) Assignee: Exceptional IP Holdings, LLC, Cary, NC (US)

( * ) Notice: Subject to any disclaimer, the term of this patent is extended or adjusted under 35 U.S.C. 154(b) by 849 days.

(21) Appl. No.: 12/098,409

(22) Filed: Apr. 4, 2008

(51) Int. Cl.
*B05C 17/10* (2006.01)

(52) U.S. Cl. ..... 425/87; 425/458; 401/139; 401/263; 401/266; 118/200

(58) Field of Classification Search ..... 425/87, 425/458; 15/235.3, 235.4, 235.7, 235.8; 401/9, 203, 266, 5, 171, 139, 263; 118/200
See application file for complete search history.

(56) References Cited

U.S. PATENT DOCUMENTS

| | | | | |
|---|---|---|---|---|
| 2,824,442 | A | 2/1958 | Ames | |
| 2,984,857 | A | 5/1961 | Ames | |
| 3,343,202 | A * | 9/1967 | Ames | 425/87 |
| 3,888,611 | A | 6/1975 | Ames | 425/87 |
| 4,516,868 | A | 5/1985 | Molnar | 401/5 |
| 5,122,006 | A * | 6/1992 | MacMillan | 401/5 |
| 7,318,716 | B2 | 1/2008 | Castagnetta, Jr. | 425/87 |
| 2006/0171761 | A1 * | 8/2006 | Castagnetta | 401/48 |
| 2007/0259064 | A1 * | 11/2007 | Mathews | 425/87 |

* cited by examiner

*Primary Examiner* — Maria Veronica Ewald
(74) *Attorney, Agent, or Firm* — Kevin Alan Wolff; Wolff Law Offices, PLLC

(57) ABSTRACT

The present invention is directed to construction tools. The present invention includes tools used for applying mastic or mud to a work surface, for example, a flat box mastic applicator tool, blade assembly, and/or blade adjustment system, that have many improvements too numerous to mention all in the Abstract. The flat box mastic applicator may include unique walls. The blade assembly may have a non-uniform cross section, e.g., a blade holder with thinner areas and/or material removed at various locations along its lateral length. The blade holder may have a larger size outer end(s) to withstand bending or braking. The blade holder may have and arched shape, ribs or bumps for holding a blade more firmly, and a ridge or bump at its outer edge to act as a dam. The blade adjustment system may include symmetrical pins or posts and a tapered leaf spring. See further improvements herein.

24 Claims, 18 Drawing Sheets

APPARATUS AND METHODS FOR BUILDING AND DRYWALL TOOLS

FIELD OF THE INVENTION

The present invention pertains to methods and various apparatus for tools. For example, the invention involves various apparatus and methods for building tools with improved blade adjustment and leveling.

BACKGROUND

Various tools have been known in the past for working with cements, concretes, mastics and/or muds to, for example, prepare, apply and finish a desired shape or smooth surface for various building surfaces. For example, some tools used for preparing the surface of, for example, concrete, include trowels. Another example are various tools used to prepare and finish, for example, mastics and mud for drywall, including, flat boxes, corner finishing boxes, joint boxes, and automatic taper (taping) machines. Some examples of various previously known flat boxes may be found in U.S. Pat. Nos. 2,824,442; 2,984,857; 3,888,611; 4,516,868; and 7,318,716, among others. In any case, regardless of type, these tools are typically hand tools that are used to apply and/or smooth various building surfaces such as floors and walls and result in skilled craftsman working on a number of surfaces for long periods of time during the work day.

One particular example of the flat box or finisher applicator 100 is illustrated in FIG. 1A and is typically made in the form of a container or housing that has a plurality of side walls, e.g., side wall 105 and front wall 110. The top of the container or housing is typically provided by a movable pressure plate 115 which is used to drive out the mud through an output port (usually in a bottom wall opposite the pressure plate that is not shown in this figure) when force is applied to the movable pressure plate 115 by the user. A set of wheels, e.g., wheel 121, may typically be attached to at least one side of the container or housing on either ends so as to enable more easy motion of the container or housing along the wall or working surface while in use when forming a relatively flat smooth layer of mastic or mud upon the wall or working surface. The moveable pressure plate 115 may be urged outward by a one or more spring(s) 116 and held closed by one or more movable tab(s) 117 attached to the container or housing with a screw 118. The various sides (e.g., 105, 110, etc.) of the container or housing may be held together using rods that run lengthwise along inside or outside the housing or container, and nuts, e.g. nuts 135 and 135, on either ends of the rods (only one end shown). Further, the flat box or finisher applicator 100 includes a blade (not shown) and a blade holder 125 that holds the blade and smoothes and distributes mastic or mud that is pushed out of the container or housing by the pressure plate 115. The blade holder may be made of a rigid metal bar and have a plurality of evenly spaced vertical cuts or slits 130 cut into it so as to improve flex. The blade holder is made to flex by a blade adjustment system including a flat spring 120 and a tension adjustment knob 122. The tension adjustment knob 122 is attached a bracket 119 that is attached to the front wall 110 of the container or housing 110. The blade holder 125 is held to the container or housing by a plurality of plates 132 attached to the side wall(s) 105 by screws 133 that penetrate the wall 133.

Referring now to FIG. 1B, an exemplary prior art mastic or mud shaping and distribution system is provided. In this case a blade 115 is a slightly bowed flat elongated piece of metal that may be place into a channel cut lengthwise in a blade holder 125. The blade holder 125 is made of a uniform cross of brass material that is periodically partially cut along its length (e.g., vertical cut or slit 130) and these cuts are uniformly distributed in order to get the needed flex from the inherently stiff brass material. The resulting mud flow pattern is generated by the user adjusting the tension of a flat spring based system, spring 120, knob 122, and pins 157A and 157B (held to the spring 120 by screws 160A and 160B), that applies forces that resist the flexing of the blade which occurs as the mud flows under the blade 115 and blade holder 125 assembly. In some prior art systems, the blade holder is produced from a uniform cross section of plastic material. In this case, the plastic blade holders typically have uniform cross section with no periodic cutting due too the reduced stiffness of the plastic material. The blade and blade adjustment system are held in place and attached to the front wall by a bracket 155 and 170. In this example, the mud flow pattern is generated by moving the center region of the blade assembly to a positive position (downward) by turning the knob 122 to a desired position. The resulting mud pattern on the wall is then a result of the gap created by the blade flexed shape with the blade center region displaced and the blade end regions held in contact with the wall.

In all previously known designs, the mud flow pattern is generated by the flexed shape of a blade and blade holder assembly which has a stiffness which is uniform along its length. Those skilled in the art will know that a uniform geometry along the length of a flexing blade will result in a relatively common shape to the mud flow pattern because the stiffness of the blade assembly will result in a flexed geometry that is consistent regardless of the material used for the blade holder.

These types of tools, for working with cements, concretes, mastics and/or muds, are typically exposed to bumps and mechanical stresses, as well as corrosive substances in their use. Therefore, it is advantageous to build such tools to be cost effective, light in weight and durable against extensive use and stress, as well as the corrosion from corrosive materials they are designed to work on (e.g., concrete, mastic, mud, etc.). Further, it is advantageous for these tools to apply a quality surface coating which requires a minimum amount of subsequent process to yield a desired finished surface contour or shape.

SUMMARY

The present invention is directed generally to tools that may be, for example, reduced in cost to manufacture and use, lightweight, high quality, corrosion resistant, durable, strong, easy to assemble and disassembly, and easy to clean. Various embodiments of the present invention may include various tools that may be used for applying mastic or mud in the construction industry. For example, various embodiments may include a container or housing made from multiple sections, wherein each section may be made of a separate piece of, for example, metal, plastic, etc., and may be used for applying mastic to, for example, drywall board on walls and ceilings of buildings. A number of walls or sections may be held together with, for example, rods and nuts or screws. The various walls or sections may be designed to include one or more approximately semicircular, or three quarter circular channels, or up to a completely cylindrical tube shapes integrally formed along the lateral length of the wall(s) or section (s) so that, for example, a screw may screw into a tapped portion formed in the farthest outer ends of the semicircular, three quarter circular, or up to completely cylindrical shaped portion of the wall(s) or section(s). Of course a rod and nut or self tapping screw may also be used in conjunction with the approximately semicircular, three quarter circular, up to a completely cylindrical shape to hold the wall(s) or section(s) together. In addition, one of the approximately semicircular to approximately three quarter circular shaped channel may be used to retain one edge of a movable plate or pressure plate. The movable pressure plate may be placed in a first opening of the housing or container so as to provide a mechanism for pushing mud in the container out an output port or hole of the container or housing so as to apply the mastic or mud in a controlled manner to a building surface, for example a drywall material or board surface. The moveable plate may be held in an approximately semicircular to approximately three quarter circular shaped channel using an elongated bushing having an elongated slot or slit formed in it to place the edge of the moveable plate therein so as to form a sealed hinged design for the movable plate to one of the walls or sections of the housing. The elongated bushing may be made of, for example, a plastic or rubber type material that will also seal the housing. Of course, if desired, a number of sides of the housing may be formed together as a single integrated piece. The invention may have a container or housing that may be generally longer than it is deep or wide, and which may be commonly known as a "flat box" in the building trades. In any case, the various embodiments may have the objective to apply the mastic or mud to a building surface, such as a wall or ceiling, in an efficient and effective manner that results in a desired pattern of mastic or mud on the wall so as to cover over, for example, a seam between two adjacent or abutting sheets of wall board or drywall material. A desired pattern may include one or more layers of mastic or mud that when dry appears to be smooth, flat, and covers over, for example, the seam and preferably needs a minimal amount of work (e.g., sanding or further mastic or mud coating) to be considered complete.

Further, the present invention may include a mastic or mud shaping and distribution system so that the mud being pushed out to the opening may be distributed on a wall, ceiling, or working surface according to a desired amount and shape. This mastic or mud shaping and distribution system may include a blade assembly that may include a blade holder and a blade. Various methods or means of holding and adjusting the blade assembly may be used. Further the mastic or mud shaping and distribution system may include a blade assembly adjustment system that may be used for flexing the blade assembly into several geometry options for use at various points in the wall or ceiling finishing process. The blade may be made of or include a durable and relatively rigid (at least in one direction) material that may resist scratching and corrosion, for example, a stainless steel, high carbon steel with a protective coating of Chrome or Titanium Nitride, etc. The blade may be embedded in the blade holder or frictionally retained in a slot or channel formed lengthwise in the blade holder. In various embodiments, the blade holder may provide increased gripping of the blade by including, for example, ribs or ridges (e.g., crush ribs) formed along and/or in the slot or channel of the blade holder. The ribs or ridges may be space apart in accordance with the extent and type of forces experienced at various locations along the lateral length of the blade and blade holder, so as to achieve better blade retention and/or more desirable blade holder flexing properties. The blade holder may also include at its outermost ends, a ridge or bump that provides a dam area to limit the flow of mastic or mud from escaping or oozing laterally out beyond the lateral length of the blade and blade holder. The ridge or bump may be formed slightly before the blade edge is reached. The blade holder may be supported in, for example, a vertical channel formed in the flat box tool, in such a way that it may be at least partially adjustably positioned. The channel may be integral to one of more of the walls or sections of the housing and adjacent to the output hole or port, it may be formed in multiple sections, the channel may be formed on at least one side that alternates in length so as to have a saw tooth or opened/closed pattern, and it may be formed as part of a unitary extrusion. In various embodiments, a support system and adjustment system may be provided to enable the blade to flex in at least part of the channel in such a way that the mud is distributed in a desired pattern with a smooth and relatively flat surface finish (that covers over the seamed area) so that, for example, the finished work surface appears to be one contiguous sheet that does not have an observable seam where two abutting sheets of drywall or building materials come together.

In various embodiments, the blade holder may have a non-uniform cross section and/or may have a lateral length that is slightly bowed or not perfectly flat to a working surface. For example, the blade holder may be at least partially thinner or have materials removed or missing at various locations along its lateral length. Further, the blade holder may be bowed up on the center of its lateral length so that a blade placed in it would touch a flat working surface at the ends of the lateral length but not at its center when the blade holder is in an un-flexed position. In various embodiments, a central section of the blade holder may have a relatively uniform height or thickness while two outer sections on either side of the central section may be generally less-high or thinner than most of the central section. In this case, the outer sections may include a relatively thin vertical wall to control leakage of mastic or mud in these thinner locations. The vertical wall may by supported by one or more thicker support members at various locations along the lateral length of the less-high or thinner location(s). The very far ends of the blade holder may be the thickest or largest cross-sectional area and may include an area that is within a channel of the housing and an area that is outside the housing. The outermost portions on either end of the blade holder may be design for increased durability to the tools being dropped or struck in that area. Further, the blade holder may be made of, for example, a material such as plastic and/or metal material that is made so that it is formed in a predetermined shape that is less rigid. The blade holder may be formed without periodic cutting, due too the reduced stiffness of the lateral length based on varying the longitudinal geometry or cross-sectional shape of the blade holder, regardless of the material(s) that may be used.

In various embodiments of the invention, a blade adjusting system may be provided. The blade adjustment system may include a knob or dial, one or more springs, a mounting bracket, one or more bushings, and one or more posts or pins, which work in conjunction to adjust the horizontal shape of the blade via the blade holder. The springs may be relatively flat elongated pieces of spring material with far ends that are bent in the same direction at approximately a 75-90 degree angle from the generally flat elongated portion. The springs may also be tapered from the central portion to a thinner width near the ends which may result in a spring with increased flexibility and lower stress characteristics than the typical rectangular springs known in prior art. The springs may be coupled between the knob or dial and the posts or pins, so as to apply force or tension to the blade holder and/or blade. The knob or dial may have, for example, five flat surfaces formed around a radius of the knob or dial that may be used to alter the horizontal shape of the blade and blade holder. These flat surfaces of the knob may be numbered, for example, from one to five. The knob or dial may also have a handle. In a first position with the knob abutting the tension springs, the blade assembly may have an arced shape relative to a flat horizontal plane. This shape may allow for placement of the largest amount of mud or mastic desired when used on the fill setting number 1 on the knob or dial. The higher the number associate with the respective flat side of the knob or dial, the more tension the system will place on the blade holder and/or blade so as to force it to a flatter or bowed outward shape. Once the fill layer of mud has been applied, subsequent applications of mud are applied using the higher settings resulting in the blade assembly being pushed to a more flat geometry. This is done by rotating the knob or dial to a higher setting number. This may displace the central location of the spring(s), which may in return result in a higher force being applied to the post(s) or pin(s). One of the pin(s) or post(s) ends may rests on a surface of the blade assembly and or blade. The increased spring force, may force the arc to be pushed flatter or bowed outward resulting in a thinner layer of mud being applied at the central location of the blade. The blade adjustment system may also include screws that are placed in the far ends of the blade holder assembly and interface with a top surface of the blade. The blade assembly ends may be further adjusted by modifying the position of the screws (turning it inward to push the blade further out or turning it outward to allow the blade to set further in the slot), which can be used to adjust the height of the blade end in the blade assembly.

In various embodiments, the mastic or mud tool may have a method where the mud flow pattern is generated by moving the center region of the blade assembly to a positive position. The resulting mud pattern on the wall is then a result of the gap created by the blade flexed shape with the blade center region displaced and the blade end regions held in place.

The post or pin(s) may be guided in the flat box frame through the bushing. This bushing may help improve the free motion (reduce friction) of the post, allowing the spring(s) forces to be more completely applied to the upper surface of the blade assembly. To simplify manufacturing and assembly, the post or pins may be designed so as to be symmetrical about its center lines, and have the same geometry at both ends. In this way the post of pins may be such that it functions the same regardless of which way assembly orientation or bushing (in the case of two or more) the post or pin is placed in the bushing(s). Note that the post may abut or be in contact with an upper surface of the blade holder and/or blade, be imbedded into the blade holder and/or blade, or abut a raised surface of the blade holder and/or blade. Therefore it is obvious to those skilled in the art that the post to blade assembly contact interface can be a raised surface or a recessed surface and anything in between. This is intended to show that the actual contact position can be modified to best suit the needs of the system or desired flat box performance.

In various embodiments, the blade may be oriented in the blade holder assembly at an angle. It has been found that the quality of the surface of the mud may be improved when the blade is oriented at an off angle relative to the working surface (e.g., an angle other then 90 degrees from the working surface plane). As such, the present invention allows the blade angle relative to the working surface to be optimized via the angle of the lateral slot formed in the blade holder or molded into the blade holder, without changing the main structure of the tool. In still other embodiments, the blade holder and blade combination may be mounted at an angle to the working surface that is not 90 degrees.

As should be appreciated, although additional exemplary embodiments and variations of the invention are provided in the Detailed Description section below, neither this Summary nor the Detailed Description section below contain all possible embodiments or variations of the present invention. Ultimately, the claimed invention is determined by the language of the claims and is not intended to be limited by the description provide in this Summary.

BRIEF DESCRIPTION OF THE DRAWINGS

Some of the objects, features and advantages of the present invention will become more readily apparent to those skilled in the art upon reading the following detailed description, in conjunction with the appended drawings, in which.

DETAILED DESCRIPTION

The present invention is directed generally to tools that may be, for example, reduced in cost to manufacture and use, lightweight, high quality, corrosion resistant, durable, strong, easy to assemble and disassembly, easy to clean, and more efficient in the use and application of working materials (e.g., mastic or mud). The present invention may include various tools and tool parts such as a container housing, a blade holder, a blade adjustment system, a skid plate, etc., that may be used for applying mastic or mud in the construction industry. For example, various tools may including a container or housing made from multiple sections and/or walls, wherein each section may be made of a separate piece, and each separate piece may be made of, for example, either metal, plastic, composite materials, etc., and may be used for applying mastic to, for example, drywall board on walls and ceilings of buildings. A number of walls or sections may be held together with, for example, rods and nuts, screws, rivets, welds, etc.

The various embodiments may have the objective to apply the mastic or mud to a building surface, such as a wall or ceiling, in an efficient and effective manner that results in a desired pattern of mastic or mud on the wall so as to cover over, for example, a seam between two adjacent or abutting sheets of wall board or drywall material. A desired pattern may include one or more layers of mastic or mud that when dry appears to be smooth, flat, and covers over, for example, the seam and preferably needs a minimal amount of work (e.g., sanding or further mastic or mud coating) to be considered complete.

The invention may have a container or housing that may be generally longer than it is deep or wide, and longer and wider than it is deep, and which may be commonly known as a "flat box" applicator in the building trades. Although this relative size may be generally true, one skilled in the art would recognize that some flat box applicators, for example, some 7 inch wide flat boxes, may come close in width and length to approximating a square shape. In various embodiments, the walls of a container or housing may be assembled together to form a box having, for example six sides. This container or housing with additional hardware may be commonly referred to in the building construction industry as a "flat box" or "flat finisher" that may be used to apply a thin wide strip of mastic on, for example, a working surface such as a drywall board ceiling or wall. One of the six sides may be a movable side, and the opposite side of the flat box may include an output port that is long and narrow, and almost the entire length of that side. Various exemplary embodiments of the present invention are shown in FIGS. 2A-12 and will be described in more detail below.

Figure 2A:
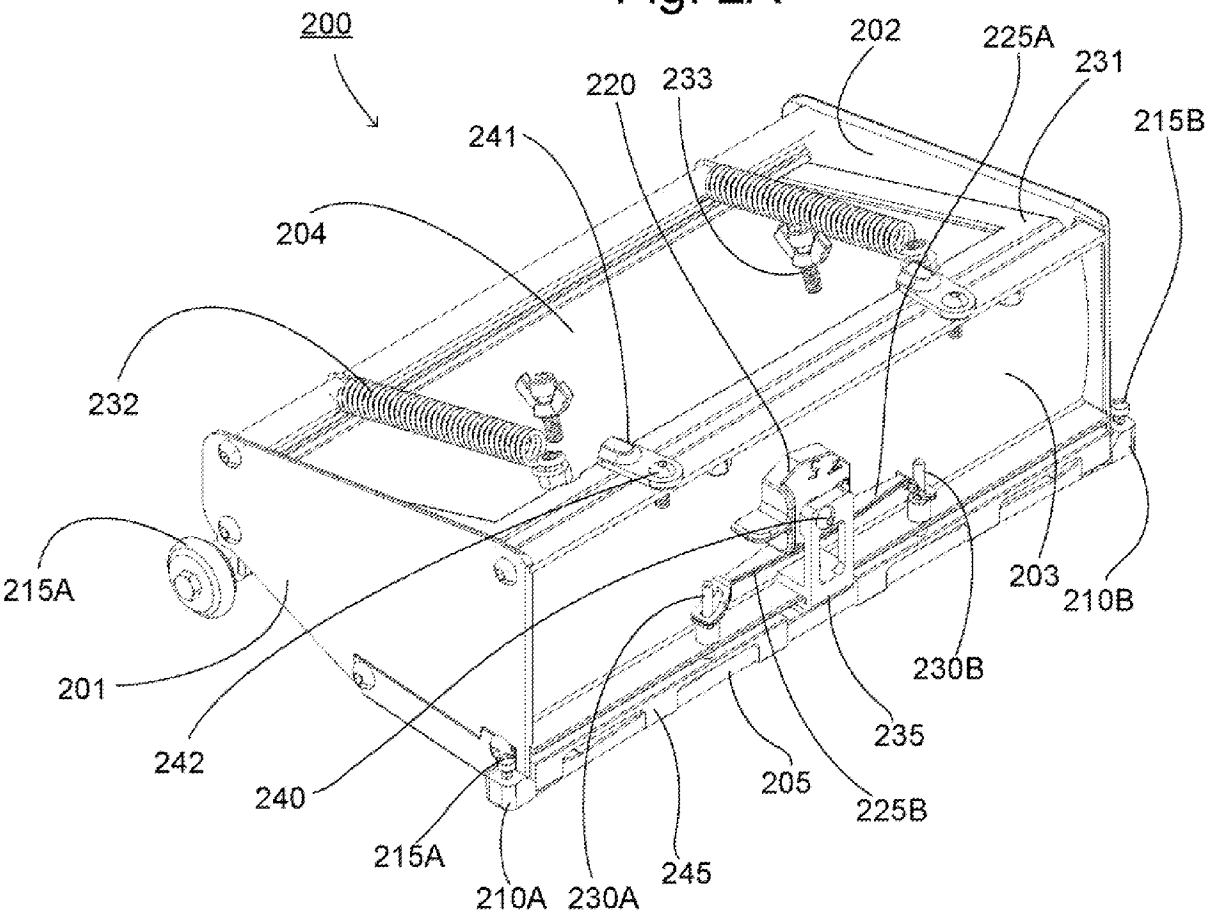
FIG. 2A illustrates a perspective or an isometric view of a mastic or mud applicator, according to at least one exemplary embodiment of the invention.

Referring to FIG. 2A, a perspective or an isometric view of a mastic or mud applicator 200, according to at least one exemplary embodiment of the invention is shown. As illustrated, mastic or mud applicator 200 is a flat box or finisher applicator having a container or housing having a first short side 201, a second short side opposite the first short side 201, a long front side 203, a long back side (not shown in FIG. 2A) opposite the front side 203, a long bottom side (not shown in FIG. 2A), and a long top side 204. These sides form together the basic structure of the container or housing into which mud or mastic may be placed so that it may be smoothly and evenly distributed on a working surface. The sides may be made from, for example, metal, plastic, or a composite material. The long top side 204 may be moveable and operates as a door to place mud or mastic inside of the housing or container and a pressure plate to push the mastic or mud out of the container or housing via an output port (not shown in FIG. 2A) formed along the front edge of the bottom side of the housing or container. The moveable pressure plate 204 may be urged outward by a one or more spring(s) 232 and held closed by one or more movable tab(s) 241 attached to the container or housing with a screw 242. The various sides (e.g., 105, 110, etc.) of the container or housing are held together with screws (shown more clearly in FIG. 2B). However, other means for holding the walls or sections together may be used, for example, in various embodiments rods and nuts on either ends of the rods may be used with, or instead of, the screws.

Further, the present invention may include a mastic or mud shaping and distribution system so that the mud being pushed out to the opening may be distributed on a wall, ceiling, or working surface according to a desired amount and shape. This mastic or mud shaping and distribution system may include a blade assembly that may include a blade holder and a blade. Various methods or means of holding and adjusting the blade assembly may be used.

Figure 2B:
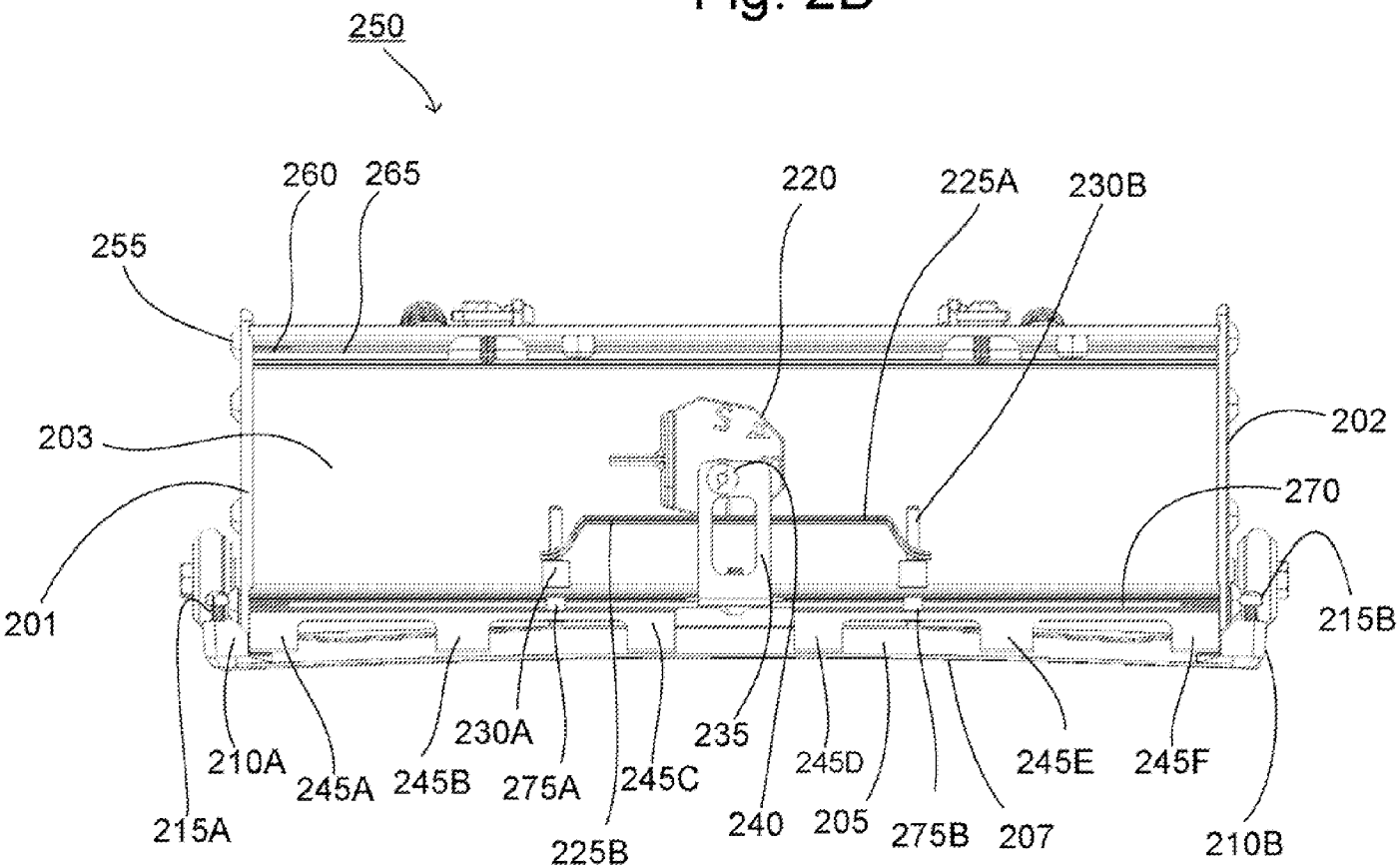
FIG. 2B illustrates a front view of a mastic or mud applicator construction showing more clearly the blade, blade holder, and blade adjusting system construction, according to at least one exemplary embodiment of the invention.

For example, the embodiment of the invention shown in FIGS. 2A and 2B may include a blade (not shown in FIG. 2A), blade holder 205, and blade adjusting system. The blade holder 205 may be retained in a channel that has one or more front wall extensions 245. The blade holder 205 may also include outer ends 210A and 210B that may be of a larger size than much of the lateral length of the blade holder 205. The ends 210A and 210B may include screws 215A and 215B that may be used to adjust the extent to which the blade is pushed into its retention channel (not shown in FIG. 2A). The blade adjustment system may include a knob or dial 220, one or more springs, 225A and 225B, and a plurality of pins or posts 230A and 230B. The knob or dial 220 may include a handle and may be held in place by a screw 240 that attaches to a mounting bracket 235 attached to the front wall 203. The knob or dial 220 may include a plurality (e.g., 5) of flat sides that may push on the springs 225A and 225B, and a plurality of numbers associate with each respective flat side of the knob or dial.

Referring now to FIG. 2B, a front view of a mastic or mud applicator construction showing at least a portion of the blade, and more clearly showing the blade holder, and blade adjusting system construction, according to the exemplary embodiment of the invention of FIG. 2A, is provided The blade 207 may be inserted into a longitudinal channel formed in the bottom of the blade holder 205 forming a blade assembly. The blade holder 205 may be formed to have an arced shape as shown, such that the blade holder and blade are lower on the ends than in the middle. This shape may allow for placement of the largest amount of mud desired when used on the lower fill settings, for example the fill setting labeled as side 1 on the knob or dial 220, as shown. Once the fill layer of mud has been applied, subsequent applications of mud may be applied as needed using higher settings that result in the blade assembly being pushed to a more flat geometry. This is done by rotating the knob or dial 220 to a higher setting number. This displaces the central location of the springs 225A and 225B, resulting in a higher force being applied to the posts or pins 230A and 230B. The force of the springs is transferred through the posts or pins 230A and 230B. One end of the posts or pins 230A and 230B may rest on a surface of the blade holder 205. The increased spring force, forces the arc to be pushed flatter resulting in a thinner layer of mud being applied. The posts or pins 230A and 230B as shown in FIG. 2B can be seen to have a spacing larger in diameter in the center and smaller diameters directed both up, to the springs, and down through holes or bushings 275A and 275B. The bushings 275A and 275B may be inserted into holes made in the front side wall 203 (described in more detail below). The projections in both directions may be the same in diameter and length allowing simple mistake free assembly (the posts or pins may be put in the holes or bushings 275A and 275B in either end direction). Such design and construction may also help to reduce manufacturing cost and increase the structural durability of the tool through the use of fewer fixed dimension parts. As previously mentioned, the blade holder ends 210A and 210B may be further adjusted by modifying the position of the screws 215A and 215B, which can be used to adjust the height of the blade end in the blade assembly. This feature may be used to maintain proper blade contact with the wall as the blade end wears in use.

Further, one or more front channel wall protrusions 245 may be provide to retain the blade holder 205 and control or limit the forward movement and or roll of the blade holder 205 during the application and spreading of mortar or mud as the flat box is moved along a working surface. For example, as shown here this embodiment has six front channel wall protrusion 245A, 245B, 245C, 245D, 245E, and 245F that are integrally formed by the same extrusion or molding as the front wall 203 and extend downward from the bottom (relative to insertion of the blade holder 205) of the channel. Of course any number of protrusions 245, or a solid lateral length short wall, may be used to control or limit the forward movement or roll of the blade holder 205. The use of protrusions 245 formed as part of the front wall 203 provides a balance between having adequate control of the blade assembly and allowing access to the area for proper cleaning after use, along with minimizing the number of parts that need to be assembled and/or taken apart for a thorough cleaning of the flat box applicator so as to remove all mastic, mud or impurities such as dirt that may accumulate during use.

This front view also shows more clearly the use of screws (e.g., screw 255) with threads (e.g., threads 260) holding sidewalls 201 and 202 to the front wall 203. Also, it can be seen that the various walls or sections of the housing or box of this exemplary embodiment may be designed to include approximately one half circle 270, approximately three quarter circular cylinder 265, or even a cylindrical channels with a longitudinal slit in it to be integrally formed along the lateral length of the wall(s) or section(s) so that, for example, the screw 255 with screw threads may be screwed into the farthest outer ends of the semicircular, three quarter circular, or cylindrical with slit shaped portion of the wall(s) or section(s) to, for example, reduce the number of parts, weight, and complexity of the container or housing.

Figure 3:
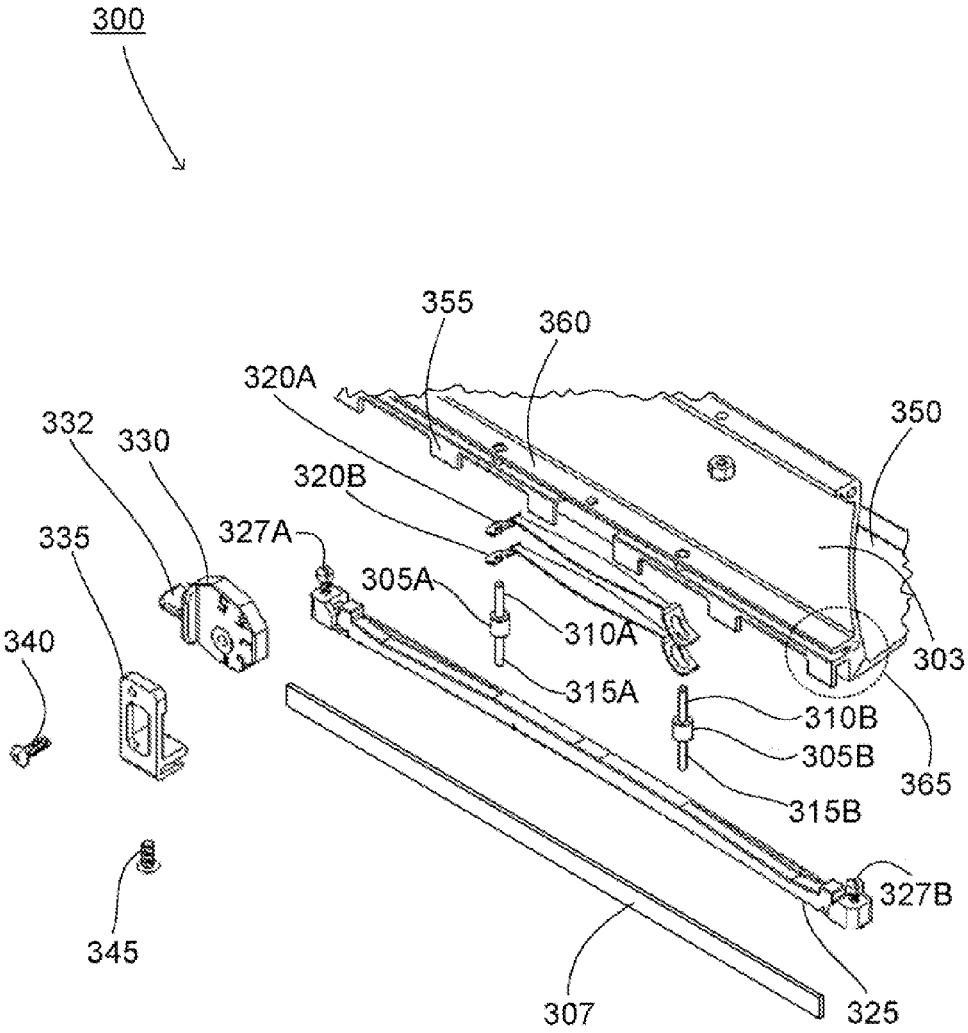
FIG. 3 illustrates an exploded view including the blade, blade holder, blade adjusting assembly construction, and break out section of the housing for the applicator shown in FIGS. 2A and 2B, according to at least one exemplary embodiment of the invention.

Referring now to FIG. 3, an exploded perspective view 300 including the blade assembly, blade adjustment systems, and a break out section of the housing for the applicator shown in FIGS. 2A and 2B, are provided. The partial perspective view of the flat box container or housing includes front wall 303 and bottom wall 350. The front wall may include a plurality of front channel wall protrusions 355 that are integral with the front wall 303, along with an integral formed mounting ledge or lip 360 upon which the mounting bracket 335 and portions of the blade adjustment system may be mounted. Again, the front channel wall protrusion 355 and the mounting ledge or lip 360 may be part of the front wall 303 as clearly illustrated by the corner edge 365 of the container or housing, and may be formed at the same time as the front wall using either extrusion or molding processes.

The blade 307 and blade holder 325 are shown in FIG. 3 as two separate items. As discussed above, the blade holder 325 may be slightly bowed upward in the middle. The blade 307 may be made as a short long narrow piece of metal that is preferably straight. Although, the blade 307 may be slightly bowed in either direction and the blade 307 may be molded directly into the blade holder 325. The blade 307 may be made of or include a durable and relatively rigid (at least in one direction) material that may resist scratching, wear, and corrosion, for example, a stainless steel, high carbon steel coated with a protective coating such as chrome or Titanium Nitride, etc. The blade holder 325 may be made of, for example, flexible materials such as plastic, including glass re-enforced g grades of Nylon or Acetal, Aluminum and/or Magnesium.

Figure 1A:
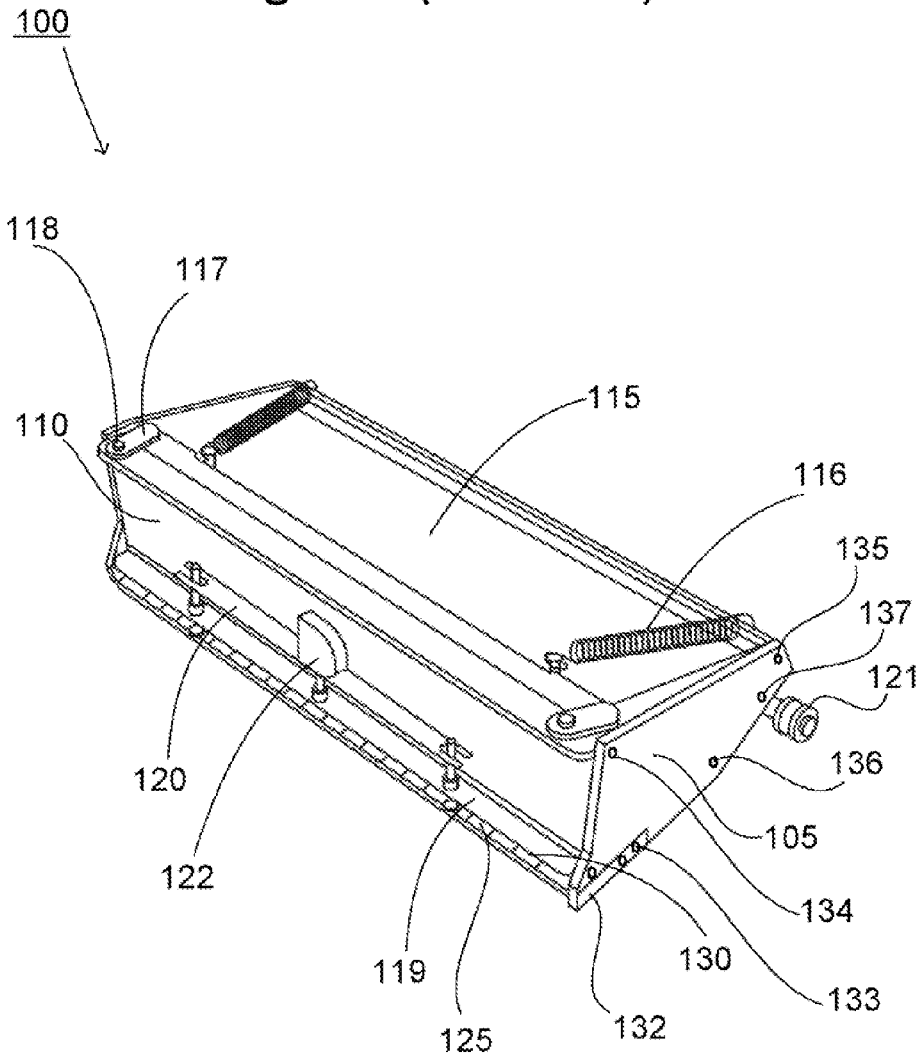
Fig. 1A (Prior Art)
FIG. 1A illustrates a perspective view of an exemplary prior art mastic applicator flat box.
Figure 1B:
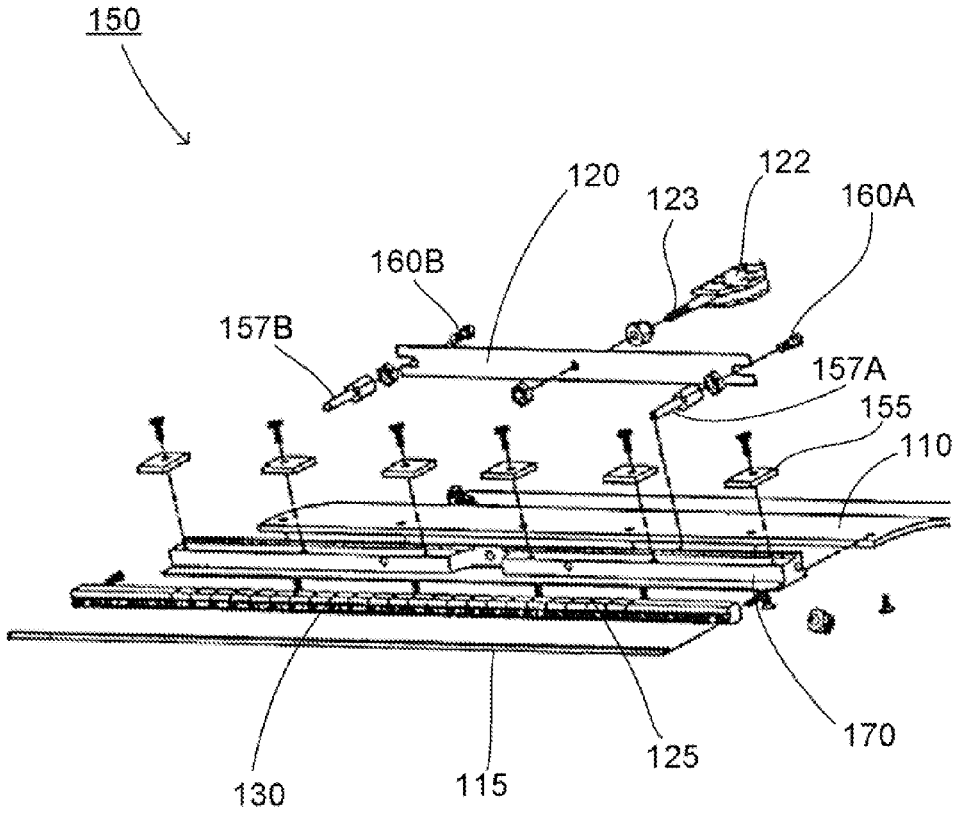
Fig. 1B (Prior Art)
FIG. 1B illustrates an exploded perspective view of one exemplary mastic applicator flat box blade, blade holder and blade adjustment system.

The blade adjustment systems may include a middle section adjustment means that applies pressure to the middle section of the blade holder 325 and end adjustment means which can adjust the blade depth from the ends of the blade holder 325. The middle section adjustment means may include a plurality of posts or pins (305, 310, 315), one or more spring(s) (320), a knob or dial (330), and a mounting bracket (335). The plurality of post or pins may be designed to be symmetrical having a larger diameter middle section 305A and 305B, and smaller diameter end sections, 310A, 310B and 315A, 315B, respectively. Designed in this way, the posts or pins are reversible so that either end 310A or 315 may be turned to interface with the blade holder 325 and may be placed on either side of the container or housing. The posts or pins may be inserted in, for example, bushings placed in holes in the mounting ledge 360 and/or the top wall of the channel for holding the blade holder 307. There may be one or two springs 320A, 320B which couple or connect to the top part of each of the posts or pins. The spring(s) 320A and 320B may be made of a spring material such as spring steel, spring grade Stainless Steel, beryllium Copper or phosphor bronze, or/and similar spring characteristic materials. The knob or dial 330 may abut on at least one side of a spring 320A along one of its flat sides or surface. The knob or dial 330 may be attached to the front wall 303 via mounting ledge by mounting bracket 335 using, for example, screw 340. The mounting bracket 335 may be attached to the mounting ledge 360 by screw 345. This mounting method is an improvement over many other tension adjustment system spring approaches in that it does not require a hole in the central location of the spring (see, e.g., the Prior Art mechanism of FIG. 1B where the knob retaining screw 123 assembles through the central hole in spring 120). The approach of various embodiments of the present invention provides a more durable and longer lasting spring. Among other things, it eliminates the need for putting a weakening hole in the highest stressed location as is done in the spring shown in FIG. 1B), thereby resulting in the spring distorting or creeping over time that results in spring force loss. Therefore, various embodiments of the present invention provide a longer lasting more durable spring and blade adjustments system that results in longer tool peak performance and life, and less loss in tool performance and required part adjustment or replacement.

As may be understood by one skilled in the art, in various embodiments of the invention, a blade adjusting system may be provided in various ways. The blade adjustment system according to FIG. 3 will now be described in more detail. The blade adjustment system may include, for example, a knob or dial 330, one or more springs 320A and 32B, a mounting bracket 335, one or more bushings (not shown in FIG. 3), and one or more posts or pins (each pin may have 3 sections 305, 310, 315), which work in conjunction to adjust the horizontal shape (e.g., bowing up and down) of the blade 307 via the blade holder 325. The springs 320A and 320B may be relatively flat elongated pieces of spring material such as full hard 301 stainless steel with far ends that are bent in the same direction, at for example approximately a 75-90 degree angle from the generally flat elongated portion, and may be coupled between the knob or dial 330 and the posts or pins, so as to apply force to the blade holder 325 and/or blade 307 (see also FIGS. 2A and 2B). The spring(s) 320 may be, for example, a tapered leaf spring and may help solve the long term spring distortion or creep problem (a reduction in the force applied by the spring). The knob or dial 330 may have a plurality of flat surfaces placed at different distances from amounting screw hole, for example, five flat surfaces formed around a radius of the knob or dial 330, that may be used to alter the horizontal shape of the blade and blade holder by applying varying amount of pressure to the spring(s) 320A and 320B. Each of the flat surfaces of the knob or dial 330 may be numbered, for example, from one to five. The knob or dial 330 may also have a handle 332 to improve the ease of turning the knob or dial 330 to a different setting. In a first position with the knob abutting the tension springs 320A and 320B, the blade assembly may have an arced shape relative to a flat horizontal working surface plane. This shape may allow for placement of the largest amount of mud or mastic desired when used on the fill setting number 1 on the knob or dial 330. The higher the number associate with the respective flat side of the knob or dial, the more tension the system will place on the blade holder 325 and/or blade 307 so as to force it to a flatter and/or bowed outward shape (depending on the number selected). Once the fill layer of mud has been applied, subsequent applications of mud are applied using the higher settings result in the blade assembly being pushed to a more flat geometry. This is done by rotating the knob or dial 300 to a higher setting number. This may displace the central location of the spring(s) 320A and 320B, which may in return result in a higher force being applied to the post(s) or pin(s). One of the pin(s) or post(s) ends 315 may rests on a surface of the blade assembly 325 and or blade 307. The increased spring force, may force the arc to be pushed flatter or bowed outward resulting in a thinner layer of mud being applied at the central location of the blade. In a maximum condition, the resulting shape may be slightly bowed out. In use, the geometry of the wall surface and flow of the mud will generally push the blade assembly and may flex it into a flat or slightly bowed shape so as to apply a fine coat of mud to fill any imperfections and leave a smooth finished surface requiring little or no further processing to achieve the desired surface geometry and density of fill.

The blade adjustment system may also include screws 327A and 327B that are placed in the far ends of the blade holder assembly 325 and interface with a top surface of the blade 307. The blade assembly ends may be further adjusted by modifying the position of the screws 327A and 327B (turning it inward to push the blade further out or turning it outward to allow the blade to set further in the slot), which can be used to adjust the height of the blade ends and blade 307 in the blade assembly. This may typically be done at initial set up and as the blade end wears with use.

Figure 4:
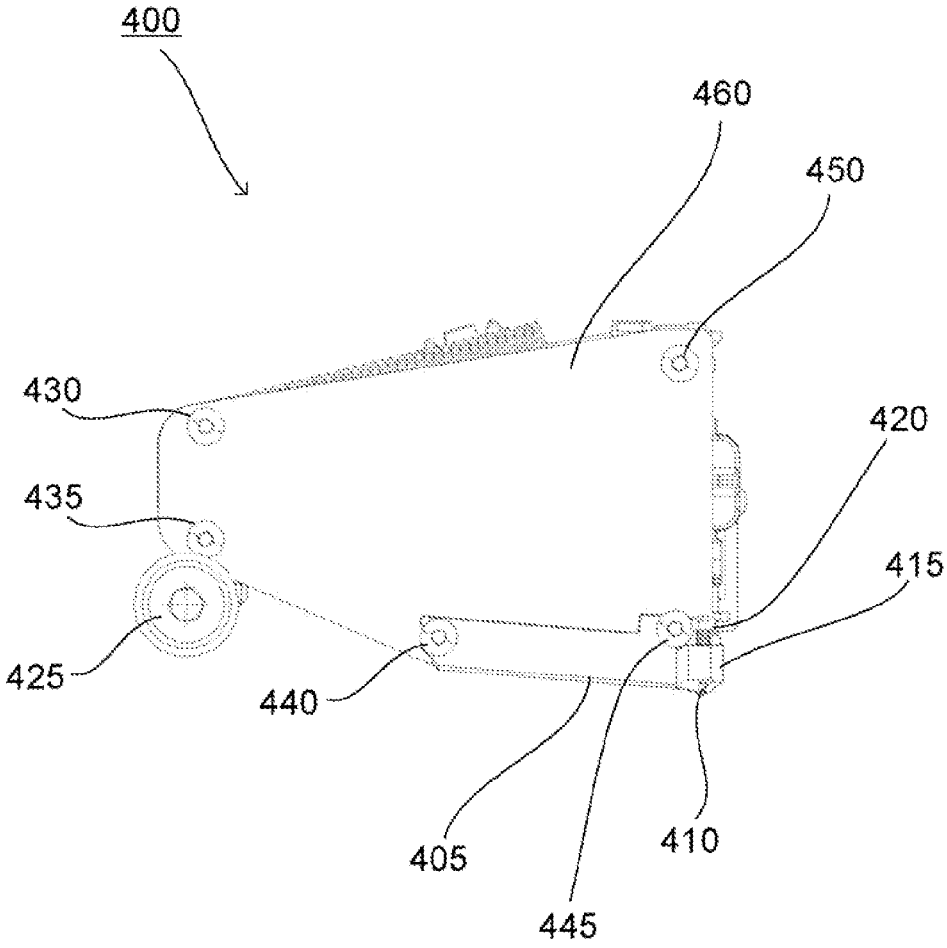
FIG. 4 illustrates a side or end view including a blade assembly end and blade assembly retaining components for the applicator shown in FIGS. 2A and 2B, according to at least one exemplary embodiment of the invention.

Referring now to FIG. 4, a side or end view 400 (left side 460 when looking directly at the front wall) including a blade assembly end and blade assembly retaining components for the applicator shown in FIGS. 2A and 2B is provided. This side view of the flat box shows the end guide or skid 405, one desired angle of the blade 410 in the blade holder 415 and relative to a working surface, a screw 420 at the end of the blade holder 415 for adjusting the height of the blade 410 and distance it protrudes from the bland holder 415, and a plurality of screws 435-450 for holding the left side 460 together with the other sides of the flat box container or housing. The end guide or skid 405 may retain the blade holder 415 (and thereby the blade 410) to the flat box container or housing by not letting it slide out the end of the container or housing laterally or fall off the bottom (vertically) of the container or housing. (See also FIG. 9.) Each of the screws 430-450 may be screwed into a circular and/or cylindrically shaped portion (described in more detail below) that runs the entire length of one of the front, bottom, or back walls of the container or housing. Further, the end guide or skid 405 may be designed so that it may be held on with one or more of the screws (e.g., in this embodiment two of the screws 440 and 445) that also hold together the walls of the container or housing. Also, instead of the traditional hole in the skid 405 for the attaching screw, the skids may have slots in them for the retaining screws 440 and 445. For example, at the location of screw 440, the skid 405 may have a slot that runs horizontally and opens toward the rear of the flat box 400 and at the location of screw 445, the skid 405 may have a slot that runs vertically and opens toward the top (movable plate) of the flat box 400. For example, screw 440 may be loosened a slight amount first, then screw 445 may loosed enough for the skid 405 to drop down and away from screw 445 (this may be from the downward force on the blade holder) via the slot in skid 405 at that screw location. Held in this position, a new blade assembly may be inserted, the skid 405 pushed back into place, and screws 440 and 445 tightened again. This may be particularly easy to achieve if the flat box is turned upside down, placing it's top wall or moveable wall on a flat surface. Further, the removal and replacement of the blade holder may be achieved even quicker if the slot or hole in the skid 405 at screw location 440 does not have an open end toward the back of the flat box, so that the skid 405 can not be completely removed unless screw 440 is completely removed. In any case, these variations may allow the skid 405 to be moved or removed with only loosening of the assembly screws allowing assembly, adjustment, or replacement of the blade assembly in less time, so as to provide a quick blade holder of blade assembly change. Further, in designing the skid 405 and attachment means (e.g., screws 440 and 445) locations this way, fewer screws or attachment means or parts may be used to make a complete flat box, and the means for connecting and holding together the various walls of the flat box container or housing may not be exposed to the inside of the container or housing where the mastic or mud may be placed before distribution or application by the flat box container or housing (as discussed in more detail below). The flat box 400 may also contain at least one wheel 425 on the back of the container or housing. The wheel 425 may be, for example, attached to an either end of a bar or axle (not shown) that may be attached at approximately the middle of the back side (making a pivot point) to make the flat box easier to slide along a work surface (e.g., a drywall wall or ceiling).

Figure 5:
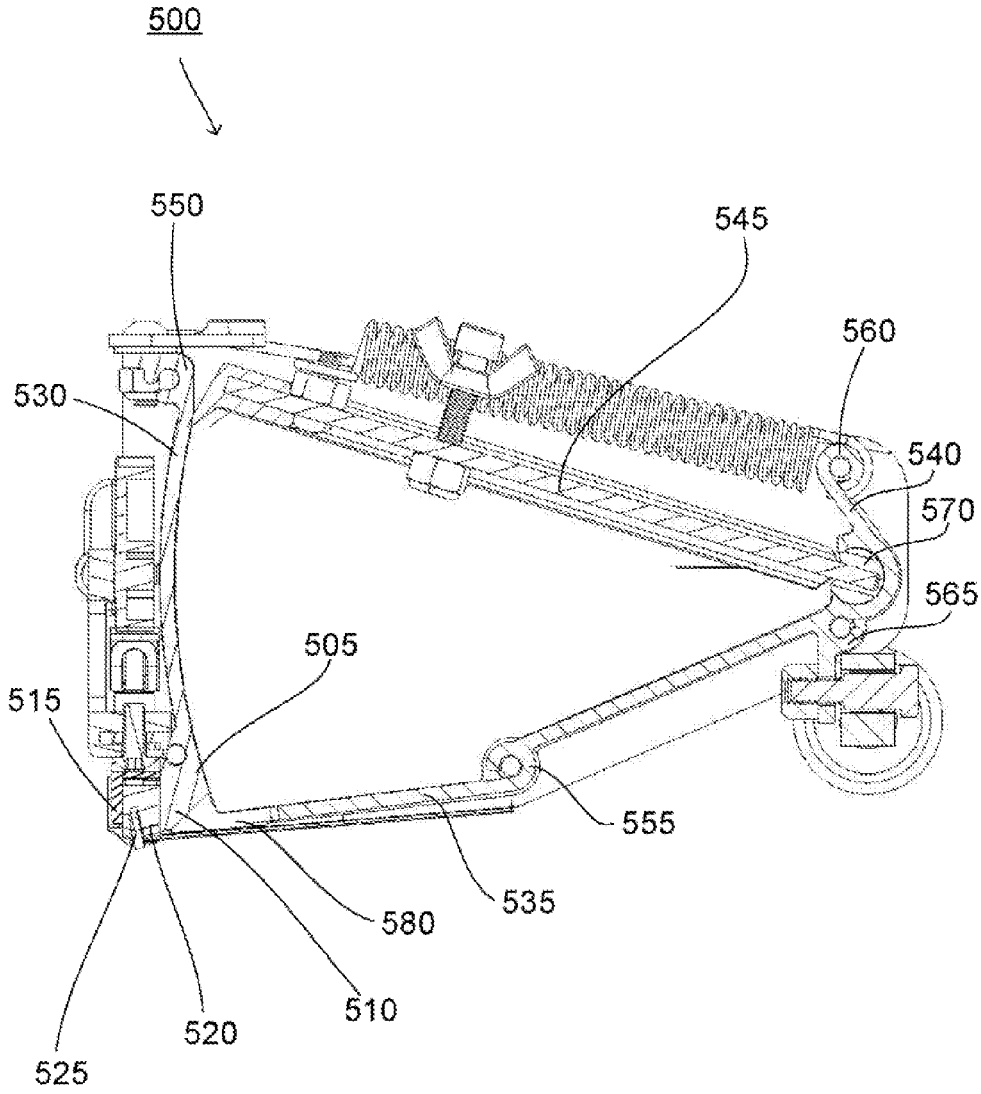
FIG. 5 illustrates a section view through the center of the tool showing the support structure of the blade assembly and the blade adjusting system for the applicator shown in FIGS. 2A and 2B, according to at least one exemplary embodiment of the invention.

Referring now to FIG. 5, a cross section view 500 through the center of the flat box (center line of the front, bottom, and back walls, and the moveable plate) showing the support structure of the blade assembly and the blade adjusting system for the applicator shown in FIGS. 2A and 2B is provided. As eluded to above, the various walls or sections of the housing, container or box of the present invention may be designed to include one or more approximately semicircular or three quarter circular channels, or cylindrical tube shapes that may be integrally formed and extend along the lateral length of various wall(s) or section(s) of the container or housing so that, for example, a screw may screw into a tapped portion formed in the farthest outer ends of the semicircular, three quarter circular, or cylindrical shaped portion of the wall(s) or section(s). Exemplary cross sectional views of these channels or tubes are shown as either full or partial loop or circle 550 in front wall 530, full loop or circle 555 in bottom wall 535, and partial loops or circles 560 and 565 of back wall 540. It is noteworthy that the partial loops or circles cross section show an opening toward the outside of the container or housing with the exception of 555 which may face internally, but away from the flow of mud inside the tool. In practical use this open internal channel will fill in the first use and may become a solid trapped portion of dried mud which will never need to be removed. Although, 555 may be a full loop, circle or closed cylinder formed on the bottom wall 535 without access from either to the inside or outside, so that the interior section of the container or housing may be completely without intrusion of screws, rods, or other wall attachment means and the mastic or mud placed in the flat box does not corrode or adversely effect the ability to remove and/or reinstall the attachment means. In any case, this type of construction helps reduce the internal obstructions so that the mud or mastic does not accumulate or dry in local areas within the container or housing so as to help reduce the frequency and thoroughness of cleaning necessary between mastic or mud applications (e.g., reduction or elimination of residual dried mastic or mud chunks forming inside the housing which may be dislodge during subsequent applications and cause imperfections in the resulting mastic or mud application on the working surface). Also, this type of unique wall connection system and integrally formed walls and attachment system construction results in a smooth outer surface for the bottom wall 535 and internal wall surfaces so that a consistently smooth and repetitive flow of mastic out the output port of the flat box. Of course, in various embodiments a rod and nut or self tapping screw may also be used in conjunction with the approximately semicircular, three quarter circular, or cylindrical shape to hold the wall(s) or section (s) together, or the full or partial cylindrical shapes may be used in alternative locations even if they may open inward to the container or housing, or outward on, for example, the bottom wall 535.

Review of the above defined embodiments covered in FIGS. 1-5, it can be seen that there are no internal features such as holes or screws that protrude into the box interior which may come into contact with the main seal (231 shown in FIG. 2A) which surrounds the moving plate 545. This seal repeatedly sweeps all the internal walls of the box during use. In prior art tools, those features may provide a path of mud leakage or result in seal abrasion and reduced life of the seal. Having no discontinuities on the inside of the box which may effect the seals life or leakage may be yet another unique and beneficial feature of this invention.

In various embodiments, one of the approximately semicircular to approximately three quarter circular shaped channel may be used to retain one edge of a movable plate or pressure plate 545. The movable or pressure plate 545 may be placed in a first opening of the housing or container so as to provide a mechanism for pushing mud in the container out an output port or hole 580 of the container or housing so as to apply the mastic or mud in a controlled manner to a building surface, for example a drywall material or board surface (not shown). The moveable or pressure plate 545 may be held in an approximately semicircular to approximately three quarter circular shaped channel using, for example, an elongated bushing 570 having a length approximately the length of the wall in which it is formed (e.g., back wall 540), and having an elongated slot or slit formed in it to place the edge of the moveable or pressure plate 545 therein, so as to form a sealed hinged design for the movable or pressure plate 545 to one of the walls or sections, e.g., back wall 540 of the container or housing. The elongated bushing 570 (only a cross section shown in FIG. 5) may be made of, for example, a plastic or rubber type material that will also seal the housing and resist corrosion. Of course, if desired, a number of sides of the housing may be formed together as a single integrated piece. See, for example, U.S. patent application Ser. No. 10/937,561 filed on Sep. 10, 2004, which is hereby incorporated herein by reference.

Figure 6:
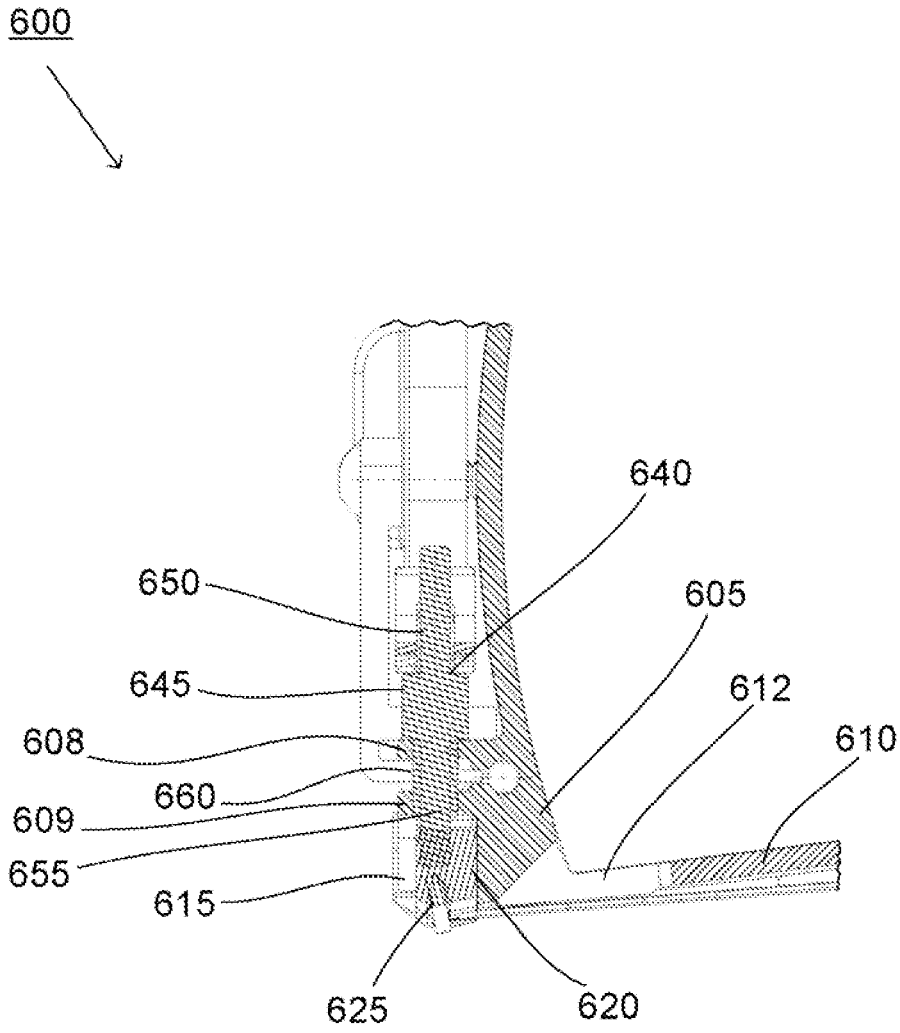
FIG. 6 illustrates a partial section view through one of the force transferring pins in the blade adjusting system for the applicator shown in FIGS. 2A and 2B, according to at least one exemplary embodiment of the invention.

Referring now to FIG. 6, a partial section view through one of the force transferring pins or posts in the blade adjusting system for the applicator shown in FIGS. 2A and 2B, according to at least one exemplary embodiment of the invention, is shown. A portion of the front wall 605 and the back wall 610 (with output port 612) is shown. Post or pin 640 is illustrated such that the simple geometry of the post can be seen more clearly with the construction of a bushing 660 included in holes in the mounting ledge 608 and the top of the blade holder channel 609 extending as the forward most portion of the front wall 605. This bushing 660 may improve the free motion of the post or pin 640 allowing the spring (e.g., 1 or 2 springs) forces to be more completely applied to and upper portion of the blade assembly (blade holder 620 and blade 625). Again, in this embodiment, one can see that the lade 625 is angled toward the back of the flat box housing rather than being perpendicular to the bottom surface of the bottom wall 610 (and thereby the work surface). Although shown here with bushing 660, one skilled in the art will appreciate that the blade adjustment mechanization may be designed without any bushing 660 and the post or pin 640 abut and extend through holes in the front wall 605. Furthermore, one of the front wall extensions 615 for the blade holder channel is shown, with the blade holder 620 positioned between the front wall extension 615 and the main portion of front wall 605 on either side, and bounded on top by the top of the blade holder channel 609.

As shown in FIG. 6, in this embodiment the post or pin 640 may be of the same geometry at both ends, having top portion 650 and bottom portion 655 being approximately the same length and diameter, so that it functions the same regardless of its assembly orientation. Further, the center portion 645 may be made to have a larger diameter than the top portion 650 or bottom portion 655 of the post or pin 640. Of course, the top and bottom ends may be made of different length so as to allow a variation in the force applied to the blade holder 620 and blade 625 if the post or pin 640 is removed and turned upside down. This different post or pin length design may allow for longer use of the post or pin 640 as the tension spring wears and becomes less rigid. Also, to combat the spring wear, more springs may be added.

Note that in the embodiment shown in FIG. 6, the post or pin 640 is shown as imbedded into the blade holder 620 of the blade assembly. This modification illustrates that the actual contact position of the post or pin 640 with the blade assembly may be modified to best suit the needs of the system. As such, it may be made clear to those skilled in the art that the post to blade assembly contact interface can be a raised surface or a recessed surface, and anything in between. Further FIG. 6 shows more clearly how the blade 625 may be oriented at an angle in the blade holder 620 of the blade assembly. As noted above, it has been found that the quality of the surface of the mud is improved when the blade 625 may be oriented at an angle relative to the working surface. This invention allows that angle to be improved without changing the main structure of the flat box. Traditional flat box tools have the blade supported in the blade holder assembly so that is parallel to the side walls of the blade holder.

Figure 7:
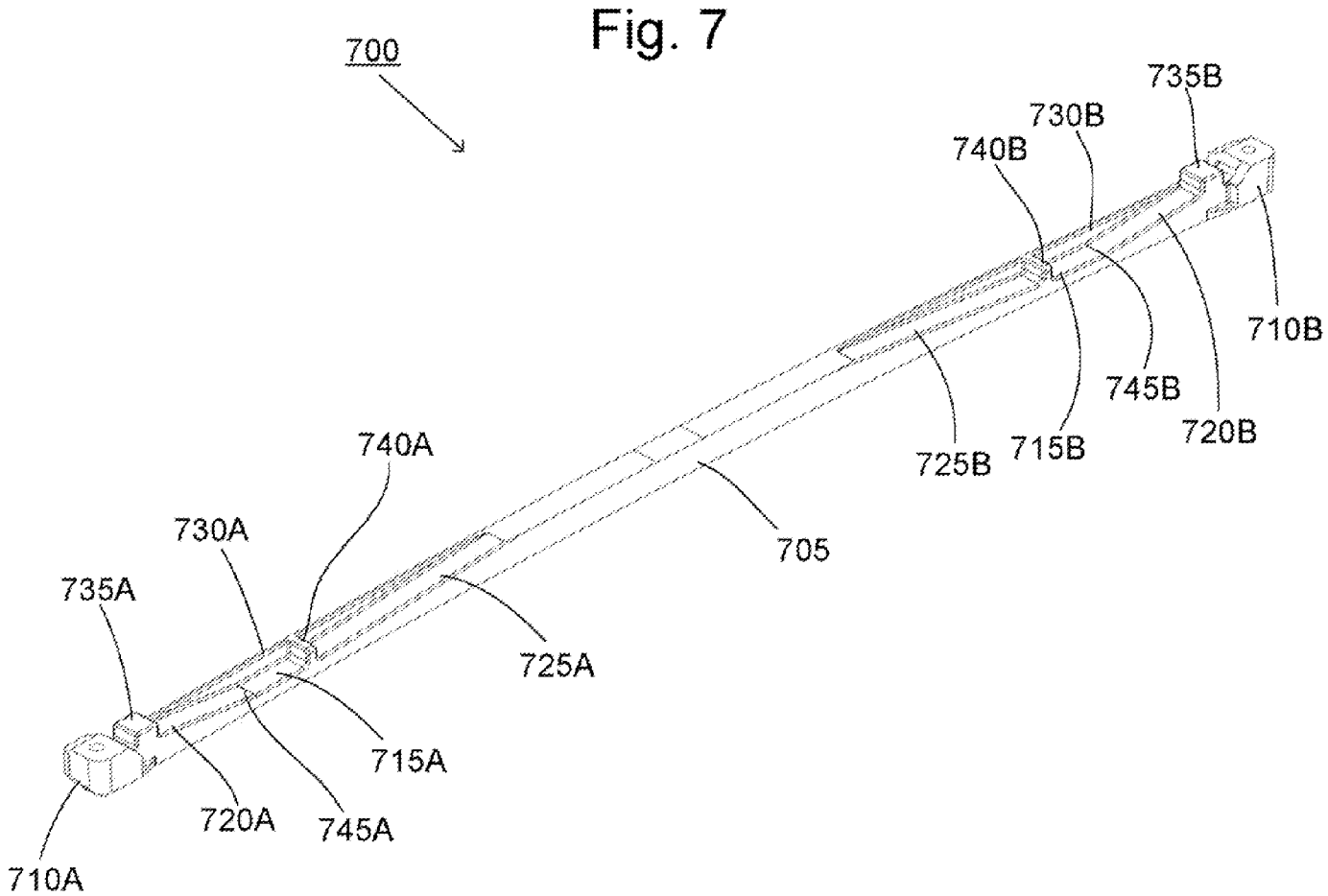
FIG. 7 illustrates a perspective or isometric view showing the top and front side of a blade holder including some of the unique features of the blade assembly that may be used in the applicator shown in FIGS. 2A and 2B, according to at least one exemplary embodiment of the invention.

Referring now to FIG. 7, a perspective or isometric view showing the top and front side of a blade holder 700 including some of the unique features of the blade assembly that may be used in the flat box applicator shown in FIGS. 2A and 2B, according to at least one exemplary embodiment of the invention, is shown. As shown, the blade holder 700 may be an elongated bar that has a central or middle section 705 and a first end 710A and second end 710B that are at opposite ends of the blade holder 700. The blade holder 700 may be made to a length that is slightly longer than the length of the flat box assembly container or housing so that first end 710A and second end 710B extend beyond the outer edge of the container or housing by, for example, ¼ to ½ an inch. The lateral length of a flat boxes container or housing (e.g., along the length of the front, back and bottom walls) may be, for example, approximately 7, 10, and 12 inches so as to be able to produce a strip of mastic or mud on a working surface having a similar width. In various embodiments, the blade holder 700 may have a non-uniform cross section. For example, the blade holder 700 may be at least partially thinner or have materials removed or missing at various locations along its lateral length.

As illustrated in FIG. 7, various embodiments may have a central or middle section 705 of the blade holder that may be of a relatively uniform height or thickness while two outer sections, for example sections 715A and 715B, on either side of the central or middle section 705 may be generally less-high or thinner than most of the central or middle section 705. In this case, the outer thinner sections may also include a relatively thin vertical wall 730A and 730B to control leakage of mastic or mud in these thinner locations. The vertical wall 730A and 730B may be supported by one or more thicker support members 740A and 740B at various locations along the lateral length in the less-high or thinner location(s). These thicker support members 740A and 740B may help to provide better structural integrity to vertical wall 730A and 730B. These thicker members further interact with the projections on the front wall of the housing that is part of the channel for holding the blade holder and may provide local guidance and anti-rotation in these locations. The less-high or thinner locations may include ramped or angled sections, for example ramps 720A and 725A on either side of flat section 715A and ramps 720B and 725B on either side of flat section 715B. These ramps or inclines may also provide a varying stiffness which may result in a more smooth shape to the blade holder 700 when it is being flexed by the blade adjustment system or mud or mastic during application of materials to a work surface, as well as keeping the blade holder from snapping in the thinned areas during stress. Although shown in this exemplary embodiment as ramps and flat areas formed with straight lines, of course, the blade holder 700 could be thinned along its lateral length in numerous ways to achieve any number of varying flex properties, characteristics or patterns. For example, ramps 725A and 725B may be on either one of, or both sides, of the thinner flat areas 715A and 715B and the various thinner regions may be formed as curved or arc shape rather than linear ramps and flat areas. Further, any area along the lateral length of the blade holder 700 may be made to be smaller or thinner to achieve desired flex properties, characteristics or patterns, for example, central or middle section 705 may be the thinnest area of the blade holder 700 and/or may be the lowest area of a continuous arc along the lateral length of the blade holder 700.

As alluded to above, the very far ends, first end 710A and second end 710B, of the blade holder may be largest cross-sectional area by height, but it also may be the thickest cross-sectional area as illustrated. In this way, the first end 710A and second end 710B may be more sturdy and design for increased durability so as to withstand a hard hit and maintain its shape and structural integrity even if the flat box is dropped or struck hard in the outer front corner(s) area at or near the first end 710A or second end 710B. The larger size of the first end 710A and second end 710B may also help to provides lateral or horizontal control of the blade holder 700 so that it will not move side-to-side (left to right) in the front wall channel of the flat box housing or container. These enlarged ends may provide increased strength for reduced damage when dropped or impacted on the side of the tool. Further, the blade holder 700, may include ridge or plateau areas 735A and 735B on either end that is just inside the first end 710A and second end 710B. These ridge or plateau areas 735A and 735B may act as a vertical stop for the blade holder 700 (left to right) in the front wall channel of the flat box housing or container into which the blade holder 700 is inserted. As such, the ridge or plateau areas 735A and 735B may also limit the lateral or horizontal movement of the blade holder 700 within the channel of the housing or container in conjunction with first end 710A and second end 710B that is outside the housing. Although, one skilled in the art would recognize that either one, or both of these areas may be designed to help limit the lateral or left-to-right travel of the blade holder within the front wall channel. In addition these raised plateaus provide a contact surface for the blade holder to the upper portion of the blade holder channel in the frame setting its position. This system, unlike other designs, may thereby result in the vertical position of the blade to be entirely defined by the front housing with no effect of the size or position of the side plates. Additionally, these plateaus have an increase surface area as compared to the side plate wall thickness which is the traditional vertical contact point at the blade holder ends. The larger surface may also reduce wear of this surface increasing the life of the blade holder.

Figure 8A:
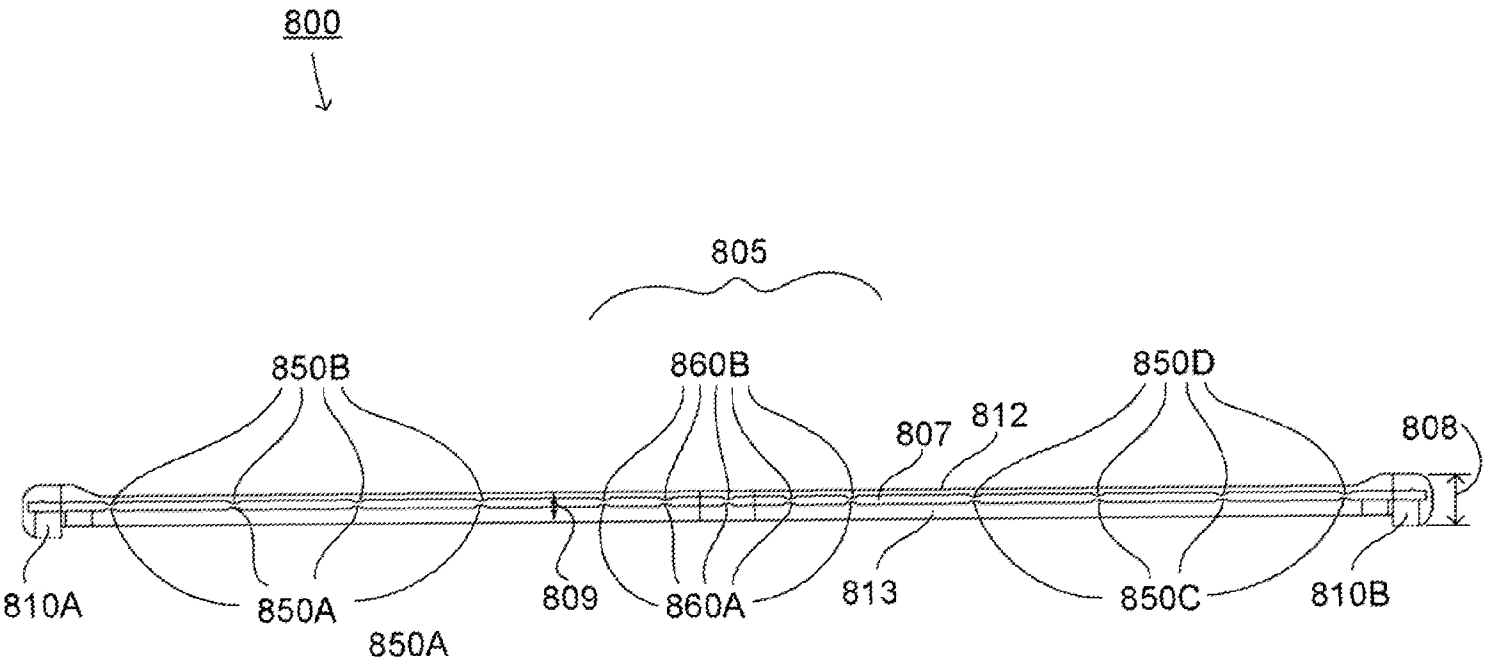
FIG. 8A illustrates a bottom view of the blade holder shown in FIG. 7, according to at least one exemplary embodiment of the invention.

FIGS. 8A-8E provide various alternative perspectives of the blade holder according to at least one exemplary embodiment, so as to provide a more clear understanding of the blade holder that may be included in the flat box depicted in FIGS. 2A and 2B. Referring now to FIG. 8A, a bottom view of the blade holder 800 (700) shown in FIG. 7 is shown, according to at least one exemplary embodiment of the invention. The front of the blade holder 800 is lateral side 812 and the rear of the blade holder 800 is lateral side 813. The opening of the channel 807 may be formed to be closer to the front lateral side 812. As is shown more clearly in FIG. 8A, the first end 810A and second end 810B of the blade holder 800 has width 808 that is wider than the width 809 of most of the rest of the lateral length of the blade holder 800. Although the blade holder 800 is shown in this embodiment to have a constant or consistent width 809 through most of its lateral length (except at the outermost lateral end areas 810A and 810B), it is possible that the width 809 may vary along the lateral length as long as it mates well with the size of the front wall channel (that may also vary in width) of the container or housing.

In various embodiments, as shown in FIGS. 8A (bottom view) and 8D (cross-sectional view), the blade holder 800 channel 807 and may provide increased gripping of the blade by including, for example, ribs or ridges (e.g., crush ribs) 850A, 850B, 850C, 850D, 860A and 860B, formed along and/or in the slot or channel 807 of the blade holder 800. The ribs or ridges, e.g., 850A, 850B, 850C, 850D, 860A and 860B, may be space apart at various intervals in accordance with the extent and type of forces experienced at various locations along the lateral length of the blade and blade holder 800, so as to achieve better blade retention and/or more desirable blade holder flexing properties. In the embodiment shown, for example, each one of the ribs or ridges 850A, 850B, 850C, and 850D on the outer lateral length of the blade holder 800 are shown to be spaced apart from one another by a larger distance than ribs or ridges 860A and 860B found in the center region 805 of the blade holder 800. As such, the gripping and holding force of the blade to the blade holder 800 would be greater near the center region 805. Further, the exemplary embodiment shown in FIGS. 8A and 8E show ribs or ridges formed on both sides of the channel 807, but one skilled in the art would recognize that alternatively ribs or ridges may be formed on only one of either of the sides, or both sides, of the channel 807 to thereby hold a blade inserted into channel 807.

Figure 8B:
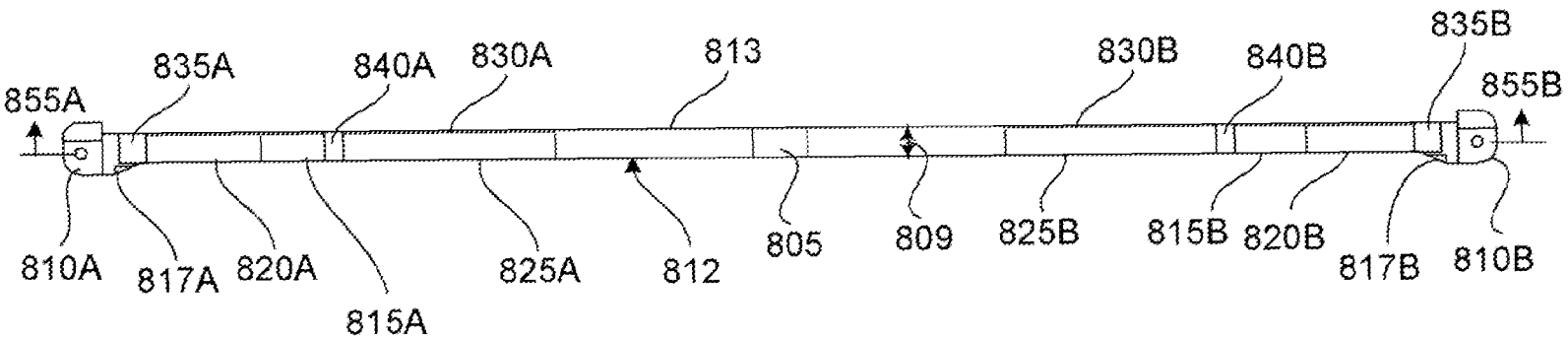
FIG. 8B illustrates a top view of the blade holder shown in FIG. 7, according to at least one other exemplary embodiment of the invention.

Referring now to FIG. 8B, a top view of the blade holder shown in FIG. 7 is provided, according to at least one other exemplary embodiment of the invention. The front side 812 is now shown to face toward the bottom of the page and the rear side 813 is facing toward the top of the page. As noted above, the blade holder 800 may have a central or middle section 805 of the blade holder that may be of a relatively uniform thickness 809 while two outer ends, for example sections 810A and 810B are wider. Further, the blade holder may also include a relatively thin vertical wall 830A and 830B formed along the rear side 813 where the blade holder has less material (e.g., locations 815, 820 and 825). This relatively thin vertical wall 830A and 830B may act as a dam to help control leakage of mastic or mud in those locations with a thin vertical wall, while also reducing the weight and providing unique flexing properties for the blade holder 800. The vertical wall 830A and 830B may be supported by one or more thicker support members 840A and 840B at various locations along the lateral length in the less-high or thinner location(s) (see also FIG. 8C). Although shown in this embodiment the support members 840A and 840B are shown to be the same width as most of the length of the elongated lateral blade holder 800, they may be more narrow, for example not as wide toward the front side 812 of the blade holder 800 or tapered in toward their top, so as to eliminate any increase friction or binding that might occur between support members 840A and 840B and the container or housing front wall channel's front most wall (if the channel front walls is solid rather than intermittent). In various embodiments, the support member 840 or/and the thin vertical wall 830A and 830B may be eliminated or increased in size. For example, the support member 840 may be eliminated and/or the thin vertical wall 830A and 830B may be made more thick for greater strength, and/or to alter the vertical flexing of the blade holder 800.

Further, the blade holder 800, may include ridge or plateau areas 835A and 835B on either farthest end that is just inside the first end 810A and second end 810B that are approximately the same width 809 as the main lateral length portion of the blade holder 800. This width 809 may be approximately the same width as the front wall channel of the flat box container or housing. Note that triangular shapes 817A and 817B are not part of the ridge or plateau areas 835A and 835B, but may be included to improve the strength of first end 810A and second end 810B so as to avoid these ends breaking off or fracturing due to impact. As may be seen more clearly from side view 8C (discussed in more detail below), these triangular shaped sections 817A and 817B may be formed as a thin wall close to the bottom surface of the blade holder 800. FIG. 8B also shows the cross-section line 855A to 855B and arrows along which FIG. 8D is derived.

Figure 8C:
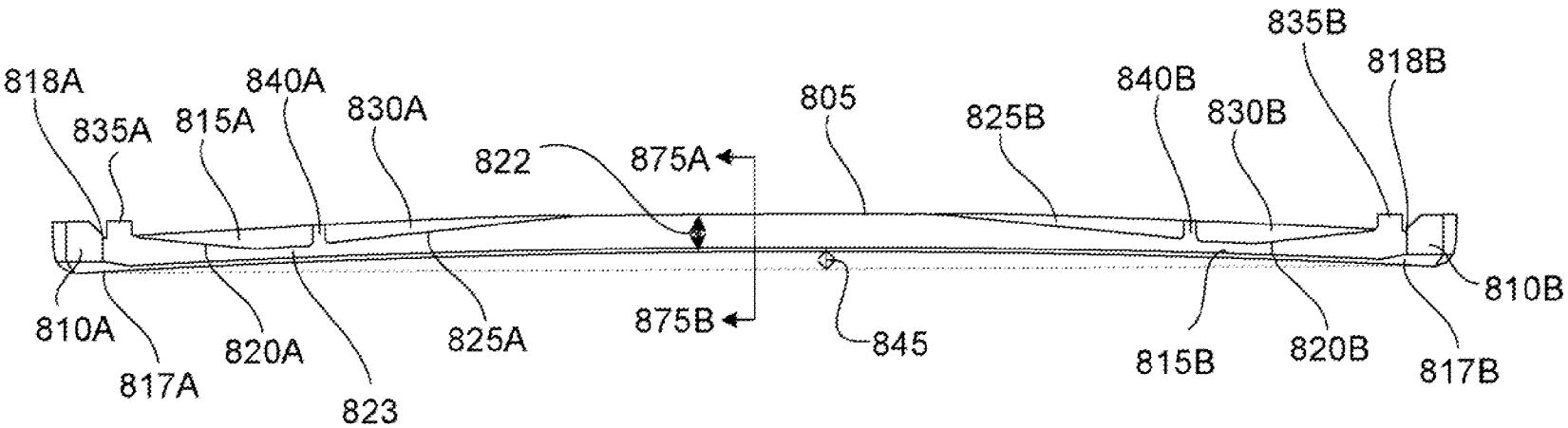
FIG. 8C illustrates a front side view of the blade holder shown in FIG. 7, according to at least one exemplary embodiment of the invention.
Figure 8D:
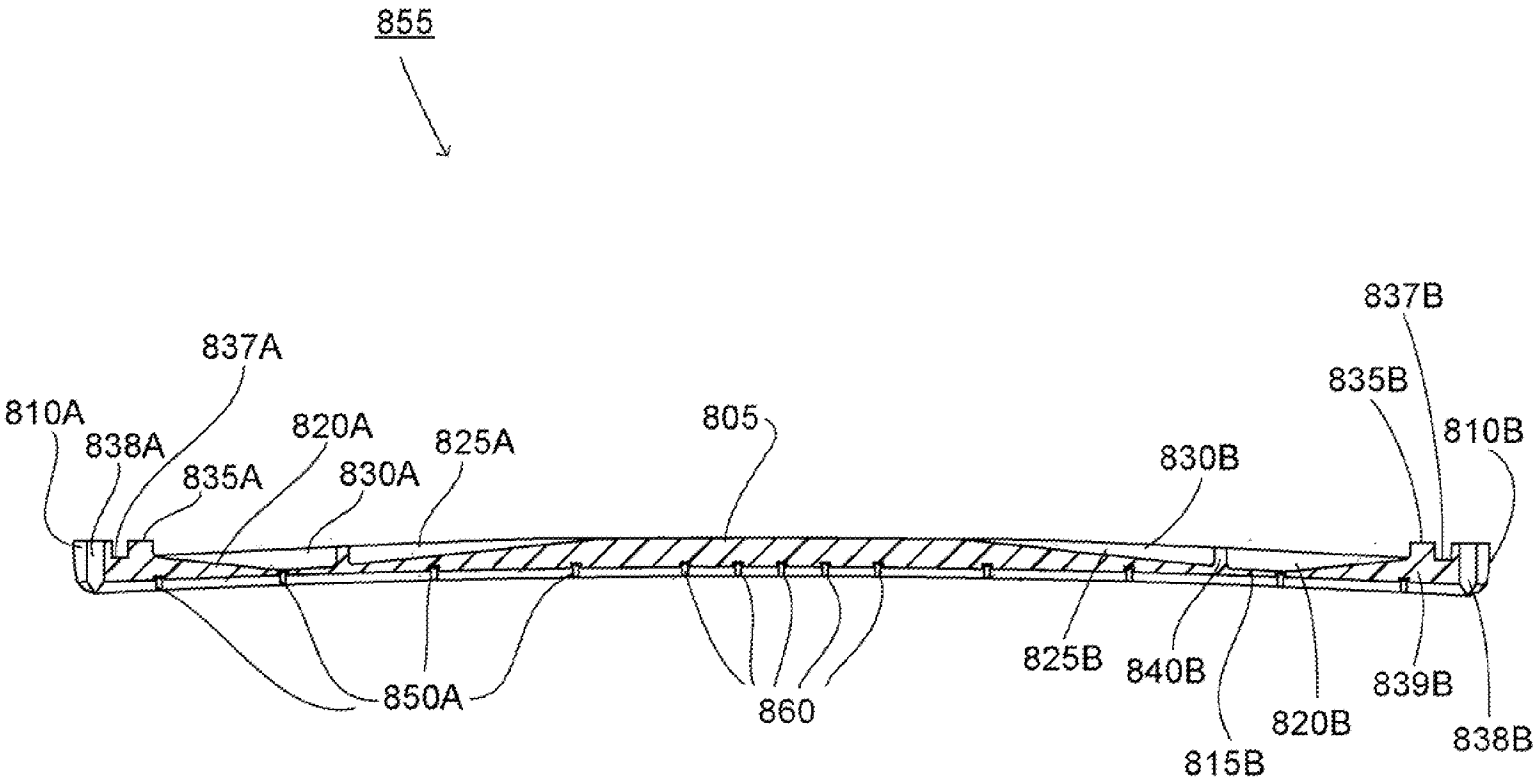
FIG. 8D illustrates a cross-section view of the blade holder along its length and through the blade channel viewed for the perspective of the cross-section line 855A, 855B as shown in FIG. 8B, according to at least one exemplary embodiment of the invention.
Figure 8E:
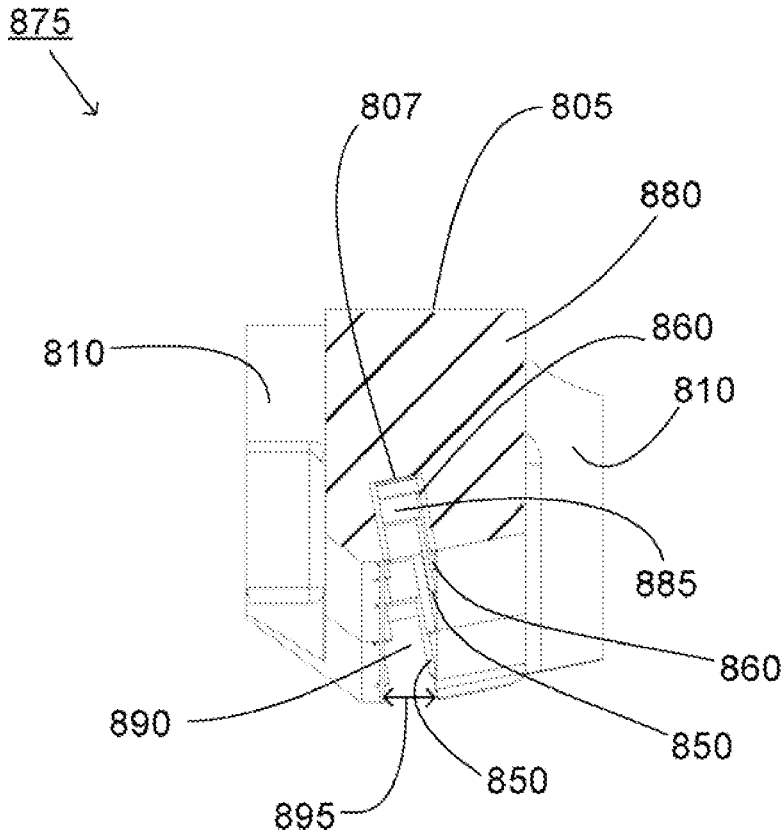
FIG. 8E illustrates a cross-section view of the blade holder taken through the center as viewed for the perspective of the cross-section line 875A, 875B as shown in FIG. 8C, according to at least one exemplary embodiment of the invention.

Referring to FIG. 8C a front side view of the blade holder shown in FIG. 7 is provided, according to at least one exemplary embodiment of the invention. The plateau areas 835A and 835B may act as a vertical stop for the end portions of the blade holder 800 (left to right) in the front wall channel of the flat box housing or container into which the blade holder 800 is inserted. Further, indent or valley 818A and 818B may be included and along with plateau areas 835A and 835B and first end 810A and second end 810B, may provide for lateral or horizontal alignment and fixation of the blade holder 800 to the walls of the flat box container or housing. (See also FIG. 2B.) The outer facing walls (facing ends 810A and 810B) and top surface of plateau areas 835A and 835B may provide pivoting points for the outer ends of the blade holder 800. The top surface of plateau areas 835A and 835B may set the vertical height or distance within the front wall channel and the inside wall surface of the plateau areas 835A and 835B may sets the axial position of the blade holder 800 in the front wall channel and flat box housing. The first end 810A and second end 810B and valley 818A and 818B may be spaced further outward and may be primarily support for the blade adjusting screws, and may help resist impacts. As such, these portions of the blade holder 800 which is why they may be spaced somewhat further outward away form the side wall of the container or housing so that they are not the first thing to hit the container or housing side wall (which may have a sharp edge). Although they may hit the side wall, the blade may be pushed over and bent by the impact just before contact with the side wall of the container or housing occurs. This unique design of the outer portions of the blade holder 800 may be done so as to reduce the chances of the end from breaking off. As such, the larger end first end 810A and second end 810B may be crushed somewhat and then transfer the impact energy to the side wall, then the box. The resulting blade holder 800 design may result in very little damage compared to the old uniform cross section type version (which could not absorb energy and just broke on impact). So generally for various embodiments of the invention, the horizontal positioning of the blade holder 800 may be done by the plateau 835A and 835B spacing from end to end.

The side view shown in FIG. 8C also illustrates the curved or bowed aspect of the blade holder 800, as indicated by distance 845 near the center area 805 of the blade holder 800. This distance shows the curve or bow from the center area 805 relative to the first end 810A and second end 810B (approximately the same curve or bow as relative to a normal flat work surface). This distance 845 may be, for example, in the range of approximately 1/32 to 1/8 of an inch, and may be a larger distance for longer length blade holders and flat boxes.

The side view of FIG. 8C also shows more clearly the varying geometries and thickness of the blade holder 800 at different points along its later length that bring further unique characteristics to the present invention. As shown, the blade holder 800 may have one or more thinner and approximately flat portions 815A and 815B that have a thickness 823 of, for example, approximately 3/16 to 5/16 of an inch. This thickness may be, for example, approximately ½ the thickness of the thickness of distance 822, that may be found in other locations along the lateral length of blade holder 800, for example near the center area 805. Of course, as noted above, the geometry for creating thinner areas along the lateral length of blade holder 800 may be different, for example, a continuous arc along the entire lateral length with the thinnest part near the center area 805 and the thickest parts at the outer end areas closer to the plateau areas 835A and 835B, and the thickness or thinness of any particular area may be selected to achieve the desired flex properties for which the blade holder 800 is being design.

Further, slopes or angles, e.g. 820A, 820B, 825A, 825B, of varying degrees may be used to reduce the thickness from the greatest thickness area(s) 822 (e.g., center area 805, ridge or plateau areas 835A and 835B, etc.) to the thinnest thickness area(s) 823 (e.g., areas 815A and 815B). These slopes or angles may help to produce a smooth transition in vertical flex properties for the blade holder 800 and blade assembly. Of course, one skilled in the art will understand that neither a thin flat area (e.g., 815A and 815B) or a slope or angle transition(s) (e.g., straight ledge may be uses) are necessary to obtain the vary cross section design of the present invention. Many variations to obtain a variable lateral stiffness may be used, such as the arc shaped mentioned above, creating a void between two thin vertical wall (e.g. thin vertical walls formed on both the front surface 812 and rear surface 813 of the blade holder 800 (e.g., two rows of vertical walls similar to 830A and 830B) that will reduce weight and give varying flex characteristics, etc. However, tapered thickness may be better because it has a cubic effect on stiffness. Other approaches may have only, for example, a 1× effect on stiffness. Alternatives where the blade represents over ½ the stiffness may result in less stiffness variation for changing the width related aspects of the blade holder 800. To achieve greater stiffness variation and flex properties, there should be a height related change along a reasonable length portion of the lateral length of the blade holder 800. In any case, the blade holder 800 design of the present invention may be adjusted or varied in various ways to obtain a desired stiffness and/or flex properties and characteristics to any particular point along the lateral length of the blade holder 800.

Figure 12:
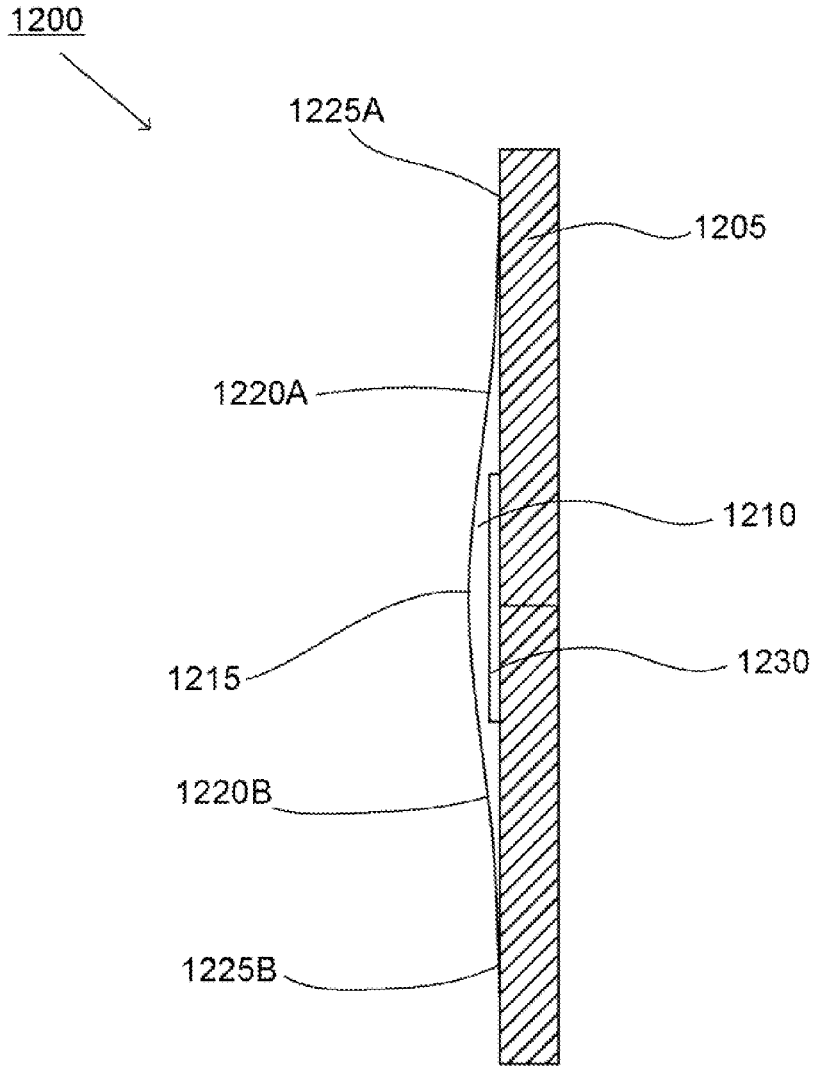
FIG. 12 illustrates a cross-section view of an exemplary mastic or mud pattern that may be produced on a working surface at, for example, a "butt joint" by using a blade assembly and/or a mastic or mud applicator, according to at least one exemplary embodiment of the invention.

It may be understood that the varying cross section design of the blade holder 800 allows the present invention to be adjusted for a desired stiffness along the length of the blade holder 800 and blade assembly (with blade included) so that its flex profile is different than that of all other blade holder designs (typically flat with relatively even stiffness along its length). This varying stiffness and/or the curvature of the blade holder 800, for example distance 845, may result in a blade assembly that may be used for applying a heavier thicker coats of mastic or mud than previously available with the blade adjustment set on the lowest tension adjustment setting, e.g., setting 1 on the knob or dial (see FIG. 2B), and lighter coats which may be done by increasing the system tension up to a setting of 5 resulting in a very thin or even finished coat of mastic or mud that does not need any further processing before completing (e.g., applying a coat of paint). Further, at each flat box tool blade adjustment setting, the reduced stiffness (e.g., as a result of having a thinner cross-section(s)) towards the outer ends, first end 810A and second end 810B, of the blade holder 800 may result in a better "feathering out" of the mud between the thicker material at the mid point of the flat box tool, and little or no mastic or mud at the very edge of the flat box tool. (See also FIG. 12 showing an exemplary cross-section of a strip of mastic or mud formed on a working surface using at least one embodiment of the present invention.) This improved result may prove very beneficial in reducing the amount of time and cost to finish a work surface, for example, a drywall seam. FIG. 8C also shows the cross-section line 875A to 875B and arrows along which perspective FIG. 8E is derived.

Referring now to FIG. 8D, a cross-section view of the blade holder along its lateral length and through the back of the blade channel viewed for the perspective of the cross-section line 855A-855B as shown in FIG. 8B, according to at least one exemplary embodiment of the invention, is shown. As indicated above when FIG. 8A was introduced, the ribs or ridges, e.g., 850A (left side of the blade holder 855) and 860 (ribs or ridges 850B not labeled in FIG. 8D), may be space apart at various intervals in accordance with the extent and type of forces experienced at various locations along the lateral length of the blade and blade holder 800, so as to achieve better blade retention and/or more desirable blade holder flexing properties. In the embodiment shown, for example, each one of the ribs or ridges 850A and 850B (not labeled in FIG. 8D) on the outer lateral length of the blade holder 855 are shown to be spaced apart from one another by a larger distance than ribs or ridges 860 found in the center region 805 of the blade holder 855. These ribs or ridges (e.g., crush ribs) are more clearly seen in FIG. 8D as being formed as small linear bumps that are perpendicular to the bottom surface and along the front wall lateral length inside the channel of the blade holder 855. Not clearly shown but understood as part of this exemplary embodiment is that the "crush ribs" shown in FIG. 8D may be similar in geometry and location to those on the other side of the blade channel (not shown in this figure) directly across from those illustrated here. This can be seen most clearly in FIGS. 8A and 8E.

Further, rather than the triangular or V shaped indent or valley 818A and 818B shown in the side view of FIG. 8C, the cross-sectional view of FIG. 8D shows that a more rectangular shaped valley 837A and 837B may be formed behind the triangular or V shaped indent or valley 818A and 818B. In various embodiments, the triangular or V shaped indent or valley 818A and 818B may be a thin wall formed only along the front wall portion of the blade holder 855 as an extension of the first end 810A and second end 810B. As such, the V shaped indent or valley 818A and 818B may provide more strength to the first end 810A and second end 810B. Further, the center contour of the thinner portions of the later length, sections 815B, 820B and 825B, as well as the cross-section view of the support member 840B is shown to be similar to the front view shown in FIG. 8C.

FIG. 8D also shows holes 838A and 838B in the first end 810A and second end 810B, respectively, for accommodating a means for adjusting the depth a blade will be setting into the channel of the blade holder 855. The blade adjustment means may be, for example, screws. As such, when screws are inserted into holes 838A and 838B the may be screwed in to a depth that abuts the blade at the deepest point of the blade channel, and further turning of the screws may apply force to the ends of the blade (not shown) and push it further out of the channel so as to thereby adjust the height of the blade (not shown). Further, an indent 839A and 839B may be formed at both ends and on the underside or bottom of the blade holder 855 to provide a location for a portion of an end guide or skid (see end guide or skid 405 in FIG. 4 and FIGS. 9 and 10 below) to help the skid (see FIGS. 2A, 2B and 4) to properly align its vertical height with that of the working edge of the blade. The indents 839A and 839B will be discussed in more detail below with reference to FIGS. 9 and 10.

Referring now to FIG. 8E, a cross-section view of the blade holder taken through the center as viewed for the perspective of the cross-section line 875A to 875B as shown in FIG. 8C, according to at least one exemplary embodiment of the invention, is shown. In this perspective of the blade holder, the relative blade gap size in the rib or ridge locations and the normal channel or groove width, for example approximately in the range of 1/32 to 3/32 of an inch, may be more clearly seen (e.g., width 895). Further, the angled nature of the blade channel or groove is also made more clear, slanting from left to right when moving from top to bottom of the blade holder 875. The cross-sectional area 880 at the center area 805 of the blade holder 875 is shown in the cross-hatching. A plurality of views of the channel 807 may be seen from this perspective starting with first channel view 885 having ribs or ridges 860 that are closest to the cross-sectional cut, being displayed nearer the center of the drawing. Looking at a sectional view from the center area 805 with the blade holder 875 bowing down, also results in the channel areas 890 and ribs or ridges 850 that are further away from the cross-section cut being displayed toward the lower part of the drawing. In addition, the left side first end 810 (810A) is shown as extending on both the left and right of the lateral length cross section 880.

In various embodiments, the blade holder 800 (700) may be made of, for example, a material such as plastic or metal material that is made so that it is formed in a predetermined shape that is not rigid and may have a desired predetermined flex pattern. The blade holder shape may be obtained using, for example, a molding process, a machining process, or a molding and machining process. And unlike the traditional metal (e.g., brass) blade holder design, the blade holder 800 (700), according to various embodiments of the present invention, may be formed without periodic cutting, due too the reduced stiffness of the more flexible or plastic material(s) that may be used.

Figure 9:
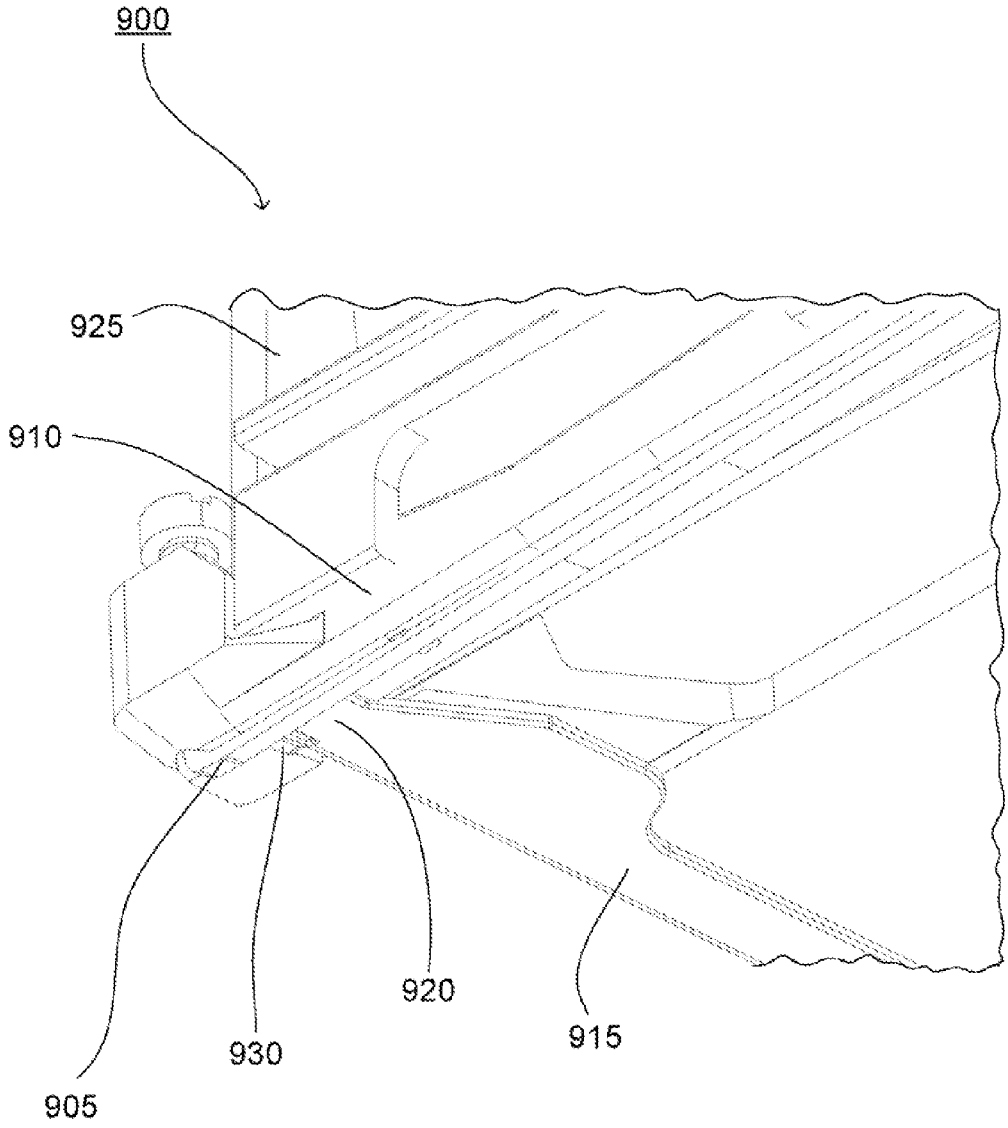
FIG. 9 illustrates a partial isometric view of the applicator including the construction relating to the retention of the blade and blade holder assembly to the housing and a raised bump or dam feature for the applicator shown in FIGS. 2A and 2B, according to at least one exemplary embodiment of the invention.

Referring now to FIG. 9, a partial isometric view 900 of the applicator including the construction relating to the retention of the blade 905 and blade holder 910 assembly to the housing and a raised bump or dam 930 feature for the applicator shown in FIGS. 2A and 2B, according to at least one exemplary embodiment of the invention, is provided. FIG. 4 discussed above provided a side view of the flat box tool which shows the end guide or skid 405 that also operates to help hold the blade assembly to the flat box container or housing and keep mastic or mud from oozing out of the sides of the blade laterally beyond approximately the location of the container's side walls (e.g., 460). This end guide 915 shown in FIG. 9 retains the blade assembly including blade holder 910 to the flat box tool container or housing 925 by not letting it slide out the end of the flat box tool (lateral travel left and right in the front wall channel) or fall off the bottom of the flat box tool. The skid 910 may engage the blade holder 910 of the blade assembly with, for example, a protruding feature 920 which retains the blade assembly. This protruding feature 920 may fit into an indent in the bottom of the blade holder 910 (see FIGS. 8E and 10). Although not clearly seen in this perspective partial view, the skid end feature 920 may also abut or mate against the blade 905. This interface along with the inner edge of the end guide or skid 915 may result in a small dam that limits the flow of mud out the side of the blade assembly. This is important because if mud escapes out the side of the flat box tool along the blade, it will result in leaving a defect on a working surface commonly known as edging in the resulting strip or layer of mud. This "edge" must then be removed by subsequent means or processing. Thus, the alignment of the skid plate 915 and its protrusion 920 to the blade 905 in the blade assembly is important for edging to be controlled. However, various embodiments of the proposed invention may have the added feature dam or raised bump 930 on the bottom surface of the blade holder 910, which may be a raised feature just outside of the skid plate-to-blade interface. This raised feature may rise above the outer surface of the end guide or skid plate 915 by, for example, from approximately 1/32 to 3/32 of an inch up to approximately the distance by which the blade 905 extends from the blade holder 910 (when the blade 905 is pushed as far as possible into the blade channel of the blade holder 910). In various embodiments, the dam or raised bump 930 may also extend partially into the blade channel a distance similar to the thickness of the crush bumps 850 and 860, so as fit tightly against the side wall of the blade 905. to make a to This feature may provide a further dam to the flow of mud to the side of the flat box tool along the lateral length of the blade 905 and blade holder 910, resulting in a flat box tool which does not edge even if the fit of the skid plate 915 and its protrusion 920 to the blade 901 and blade holder 910 is somewhat out of alignment. Some of the blade holder features may be seen more clearly in FIG. 10.

The end guide or skid plate 915 may be made of, for example, a metal plate that is bent at a 90 degree angle so as to wrap around the end side walls (e.g., 460) of the flat box container or housing. The end guide or skid plate 915 may be stamped from a flat sheet of, for example, stainless steel, heat treated steel, etc. Of course, other materials may be used as long as it is durable enough to withstand the corrosion properties of the mud or mastic and the scrapping action of running the flat box along a working surface such as drywall board.

Figure 10:
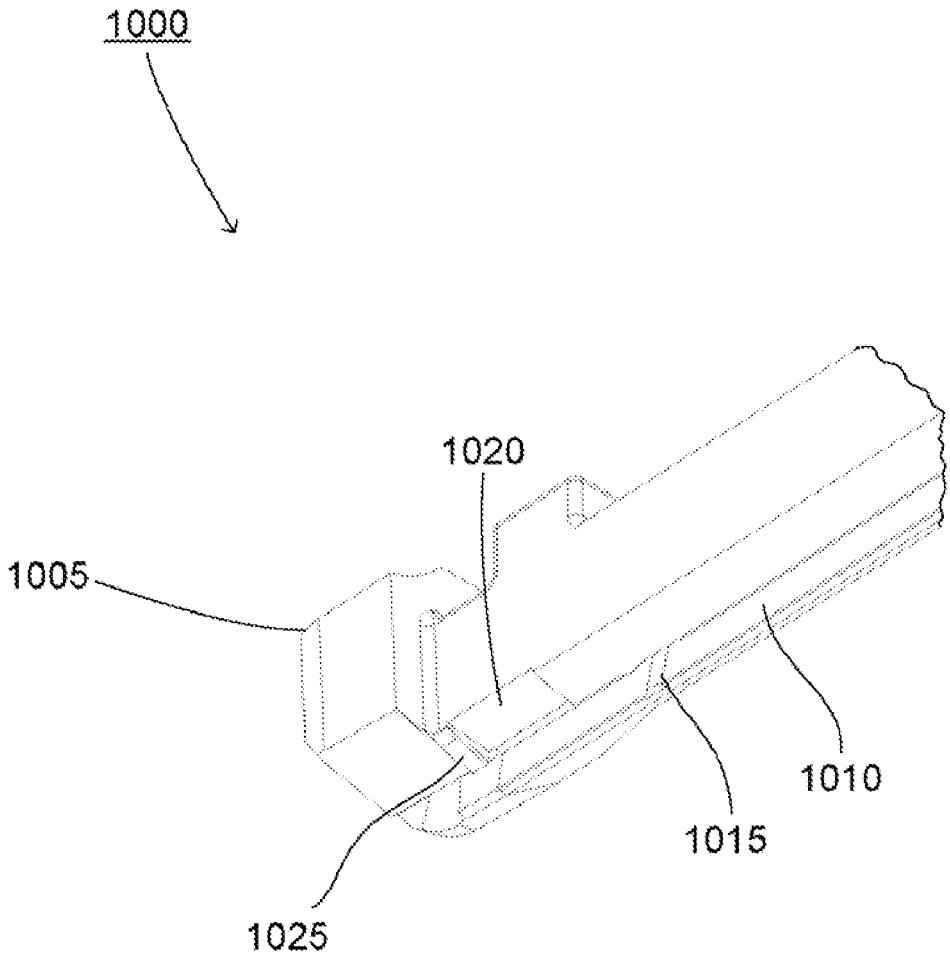
FIG. 10 illustrates a partial perspective or isometric view of the underside or bottom and backside of one end of the blade holder including some of the unique features of the blade assembly, according to at least one exemplary embodiment of the invention.

Referring now to FIG. 10, a partial perspective or isometric view 1000 of the underside or bottom and backside of one end of the blade holder 1005 including some of the unique features of the blade assembly is provided, according to at least one exemplary embodiment of the invention. Here, the blade channel 1010, one of the bump(s) or rib(s) 1015 (e.g., crush rib) formed in the channel 1010, an indent 1020 for receiving the end guide or skid plate, and the addition dam means, raised bump 1025, formed on the bottom of the blade holder 1005 are more clearly illustrated. As can be seen from this perspective view, the bump(s) or rib(s) formed in channel 1010 may be formed on the front wall of channel 1010 and have a curved outer surface facing into the channel with a rounding or angled surface at the outer most surface of the channel to help a blade slide into the channel more easily. The indent 1020 formed in the bottom of the blade holder 1005 for receiving the protrusion of the end guide or skid may be relatively flat and extend from the back or rear wall of the blade holder 1005 to the edge of the channel 1010. The indent 1020 may help to ensure that there is proper alignment of the blade holder 1005 (and thereby the blade and blade assembly) with the end guide or skid. Further, the addition dam means or raised bump 1025 may be formed on the bottom surface of the blade holder 1005 and along or coincident with the outermost side of the indent 1020. The ridge or bump 1025 may be formed slightly before the blade edge is reached. The raised bump 1025 may be made so as to stick out beyond (bellow) the outer surface of the end guide or skid and form an additional abutment, dam, or obstruction to keep mud or mastic from oozing out along the lateral length of the blade beyond the end of the blade and blade holder 1005. For example, the raised bump or dam may have a height of approximately 1/32 to 3/32 of an inch, and should not extend beyond the height of the blade that extends beyond the bottom surface of the blade holder 1005 (when the blade is fully inserted into the blade holder 1005 and seated to the bottom of the blade channel 1010). As such, the height of the raised bump or dam 1025 should be above the thickness of the end guide or skid but below the top edge of the blade so as to act as a lateral dam for the mastic or mud without forming a defect line or edge (e.g., edging) in the mastic or mud distributed on a work surface (e.g., drywall board). As such, the indent 1020 for receiving the end guide or skid plate, and the addition dam means, raised bump 1025, formed on the bottom of the blade holder 1005 may be designed in such a way that mastic or mud is distributed in a desired pattern with a smooth and relatively flat surface finish (that must cover over, for example, a seamed area) so that, for example, the finished work surface appears to be one contiguous sheet that does not have an observable seam or edge and a seam between two abutting sheets of drywall or building materials may not be seen by the naked eye.

Figure 11:
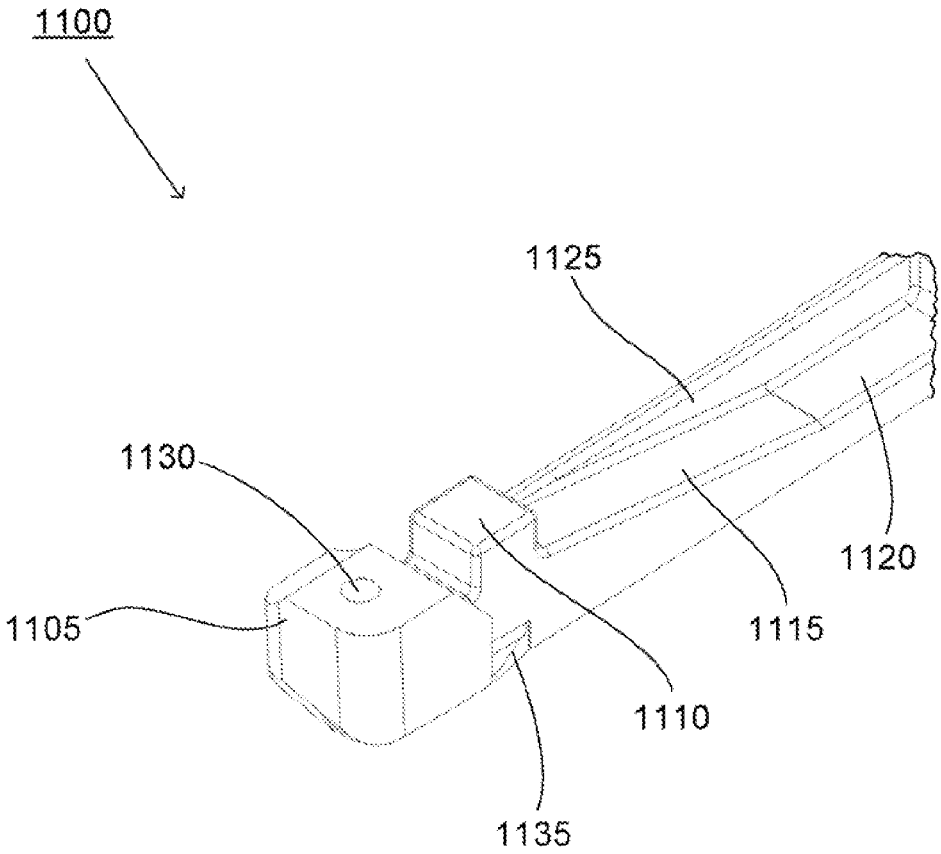
FIG. 11 illustrates a partial perspective or isometric view of the top and front sides of one end of the blade holder showing some of unique features of the blade assembly, according to at least one exemplary embodiment of the invention.

Referring now to FIG. 11, a partial perspective or isometric view of the top and front sides of one end of the blade holder 1100 showing some of unique features of the blade assembly is provided, according to at least one exemplary embodiment of the invention. This partial enlarged view more clearly shows how the end 1105 of the non uniform composite blade holder 1100 may be significantly larger than the main lateral length of the blade holder 1100. This larger end 1105 may have increased strength and act as a bumper when the flat box tool is dropped or banged on the side. In this way the blade holder end 1105 may absorb the impact, but is much less likely result in damage that affects the blade holder 1100 shape or the shape of the blade itself. Further, the triangular feature 1135 may be included to further increase the durability of the lateral end 1105 of the blade holder 1100. This triangular feature may act as a support or bracket that may connect the inside surface of end 1105 to the front surface of the narrower lateral length of the blade holder 1100 so as to reinforce the strength of the end 1105 from breaking apart from the rest of the blade holder 1100 upon impact from dropping or hitting a hard working surface (e.g., hardwood wall piece or flooring). Therefore, the flat box tool including this larger end 1105 feature is far less prone to damage, allowing the tool user to keep working if the flat box tool is dropper or set down abruptly on its corner. With various embodiments of the present invention, the tool user may work longer without taking time to fix, repair, or adjust the blade holder 1100 or blade.

FIG. 11 also shows the raised or plateau feature 1110 which is a raised region of the blade holder that may contact the frame in the front wall channel of the container or housing (see FIG. 2B) and establish the standard location height of the blade holder 1100 and ultimately the blade ends in the tool. The plateau or raised feature 1110 may mate with the top of the frame channel which may be part of the front wall frame extrusion. In this way, the position of the entire blade assembly is defined by relatively few surface features and these features may all be produced in the same part. In doing so, manufacturing cost may be further reduced, and quality of production and therefore function is more repetitive from one flat box tool to another flat box tool in production.

FIG. 11 also shows the more clearly some of the non-uniform shape, geometry and characteristics of the blade holder 1100 that are provided along its working lateral length. For example, the thinner flat area or region 1120, the thinner sloped or angled region 1115, and the raised back wall region 1125 can be seen more clearly to have different geometry than the main length of the blade holder 1100 (see FIGS. 8C and 8D). As previously noted, this shaping changes the stiffness and flex properties of the blade holder 1100, and therefore the blade assembly along the working lateral length of the blade. This non-uniform stiffness and flexing properties allows the deflection of the blade assembly to be custom designed to result in the varying desired shapes for providing different and/or better geometry for an applied layer of mastic or mud. The change in stiffness along the lateral length of the blade may enable the design of the ideal blade deflected shape, while using a standard blade cross-section and common knobs, springs and posts for any of several different sizes of flat box tools. In fact, the blade holder 1100 may be designed to have a non-uniform shape, geometry, and/or characteristics that may interface with any of the flat box designs presently available in the market as, for example, a blade holder or blade assembly replacement part. In any case, the invention allows commonality in manufacturing to reduce costs while also improving the performance and life of the blade holder 1100 and blade assembly for flat box type tools.

The shape, geometry and flex characteristics of the blade holder 1100 may be further modified to include one or more vertical wall(s), such as vertical wall 1125. This aspect of the blade holder 1100 design may allow the presentation of complete surface to the frame front wall channel of the container or housing, even along the lateral length of the blade holder 1100 where the height has been reduced (thinner areas) to reduce the local stiffness for improved flexibility. The vertical wall 1125 may be formed along the back surface of the blade holder 1100 so as to maintains a common desired height against the back wall of the front wall channel and help to keep mud from leaking or oozing past the blade assembly in these thinner areas of the blade holder 1100. In various embodiments, the vertical wall may be place in the center of the lateral length or multiple vertical wall may be include.

As previously noted, the blade may be placed at an angle in the present invention. In various embodiments, the blade may be oriented in the blade holder assembly at an angle. It has been found that the quality of the surface of the mud may be improved when the blade is oriented at an off angle relative to the working surface (e.g., an angle other then 90 degrees from the working surface plane). As such, the present invention allows the blade angle relative to the working surface to be optimized via the angle of the lateral slot formed in the blade holder or molded into the blade holder, without changing the main structure of the tool.

Referring now to FIG. 12, a cross-section view 1200 is provided for an exemplary mastic or mud pattern that may be produced by using the blade assembly and/or the mastic or mud applicator of the present invention. In various embodiments, the mastic or mud flat box tool and/or the non-uniform flex or geometry blade may be used to provide a method where the mastic or mud flow pattern 1210 that may be a stripe formed along a working surface 1205 and generated according to the shape shown in FIG. 12. As can be seen from this example, the center portion 1215 of the mastic or mud stripe 1210 may be highest and may be slightly bowed out (convex shape) from the working surface 1205. On the other hand, the outer portions 1220A and 1220B of the mastic or mud stripe 1210 may be slightly bowed inward (concave shape) toward the working surface 1205. As such, the mastic or mud stripe 1210 may be thinner to the working surface 1205 (shown here at two abutted sheets of, for example, drywall having a sheet of tape 1230 covering the a seam area) at its outermost ends 1225A and 1225B so as to feather smoothly to the flat working surface 1205. The cross section view of a mastic or mud stripe made from a prior art or traditional flat box design would look generally like a convex mound of material on the flat working surface making the interface between the two more abrupt. As such, the present invention may provide a better mastic or mud stripe geometry than the prior art or traditional flat box designs.

It may be noted that the height of the center portion 1215 of the stripe may be increased or decreased by, for example, moving the center region of the blade assembly to a more or less positive position, using for example the blade adjustment system shown in FIGS. 2A and 2B. The resulting mastic or mud pattern on the working surface 1205 (e.g., a wall or ceiling that may include drywall board) may then be made higher or lower to the working surface 1205 as a result of the difference in gap created by the blade flexed shape with the blade center region less or more displaced and the blade end regions held in place. In any case, the present invention may be set in such a way that the mud is distributed in a desired pattern with a smooth and relatively flat surface finish (that may be used to cover over a drywall seamed area) so that, for example, the finished work surface appears to be one contiguous flat sheet or surface that does not have a observable seam where two abutting sheets of drywall or building materials come together, a ridge, or any imperfections perceivable by the naked eye. The present invention is able to achieve such a surface more efficiently, with fewer steps, than the prior art blade assemblies or flat boxes.

Although a particular embodiment(s) of the present invention has been shown and described, it will be understood that it is not intended to limit the invention to the preferred embodiment(s) and it will be obvious to those skilled in the art that various changes and modifications may be made without departing from the spirit and scope of the present invention. Thus, the invention is intended to cover alternatives, modifications, and equivalents, which may be included within the spirit and scope of the invention as defined by the claims.

All publications, patents, and patent applications cited herein are hereby incorporated by reference in their entirety for all purposes.

What is claimed is:

1. An apparatus, comprising:

a container for dispensing mastic onto a working surface; and a blade assembly having a non-uniform flex profile along its lateral length and mounted to the container in such a manner so that the blade assembly maintains the non-uniform flex profile along its lateral length, wherein the blade assembly includes a blade holder that is preformed in an arched shape and whereby during use an application of mastic occurs in a non-uniform shape.

2. The apparatus of claim 1, wherein the blade assembly includes a blade holder having a non uniform cross section along its lateral length and a uniform cross-section blade supported within the blade holder.

3. The apparatus of claim 1, wherein the blade assembly includes the blade holder arched shape is for applying heavier coats of mastic.

4. The apparatus of claim 1, wherein the blade assembly includes a blade holder that has periodic small ribs within a blade groove or channel so as to close the width of the groove or channel locally to a distance less than the width of the blade.

5. The apparatus of claim 1, wherein the blade assembly includes a blade holder that has at least one furthest out lateral end of a much larger cross section than that found in the working lateral length of the blade holder.

6. The apparatus of claim 1, wherein the blade assembly includes a blade holder with a cross section that varies along the working length of the blade.

7. The apparatus of claim 1, wherein the blade assembly includes a blade holder with a vertical wall located in a smaller cross section area which results in an approximately uniform height area of mating between the blade holder and the inside or back wall of a front wall channel of the tool container.

8. The apparatus of claim 1, further comprising:

a single piece skid and blade assembly retention plate having at least one mounting slot formed therein, so as to provide easy assembly and disassembly of the blade assembly to the container.

9. The apparatus of claim 1, wherein the blade assembly includes a blade holder with a raised portion at either end in order to provide a vertical contact surface with a top wall of a front wall channel of the tool container, so as to establish vertical position of the blade assembly ends.

10. The apparatus of claim 1, wherein the blade assembly includes a blade holder with a blade groove formed at an angle relative to the lateral outer front and back surface walls of the blade holder.

11. The apparatus of claim 1, wherein the blade assembly includes a blade holder, wherein the blade holder has a dam ridge formed on an end area bottom surface and abutting at least one side of the skid, the dam ridge being a height that will keep mastic or mud from oozing beyond of the lateral length of the blades assembly.

12. A tool for applying mastic, comprising;

a box like housing with a movable plate;

an output port or hole in the box for mastic to flow out of in response to movement of the movable top;

a flexible blade assembly including a blade holder and a blade, the blade assembly mounted to the front region of the housing adjacent to the output port; and a blade adjustment system including at least one leaf spring having a shape that improves spring life and durability by including a tapered shape, a shape without a central through hole, or a tapered shape without a central through hole.

13. The tool of claim 12, wherein the at least one leaf spring has a non-linear lateral length with preformed bends.

14. The tool of claim 12, further including at least one symmetrical post coupled to the leaf spring, wherein the post is reversible in assembly.

15. The tool of claim 12, further including at least one fixed nonadjustable length post coupled to the leaf spring.

16. The tool of claim 12, wherein the blade adjustment system further includes a mounting bracket, a knob for turning to vary tension on the blade, wherein the mounting bracket is mounted to an integrally formed mounting shelf of a front wall of the box like housing and the knob is mounted between the front wall and the mounting bracket but supported only by the mounting bracket, such that no holes are made through the front wall into the interior of the box like housing.

17. The tool of claim 12, wherein the box like housing includes a single piece front wall including a blade assembly channel including an integrally formed front wall including blade holder channel protrusions, an blade adjustment system mounting location, or a three quarter circular screw mount channel, that is integrally formed as a single piece front wall.

18. The tool of claim 12, wherein the blade holder has a preformed bowed lateral length, a non-uniform flex profile along its lateral length, a non-uniform cross-sectional geometry along its lateral length, an angled blade channel, ribs in the blade channel, a lateral wall in thinner areas of the lateral length, or an end that is bigger in cross-section than the cross-section of the lateral length.

19. The tool of claim 12, wherein the blade assembly is mounted to the front region of the housing with an easy assemble single piece end guide or skid plate with at least one mounting slot.

20. The tool of claim 12, wherein the at least one tapered leaf spring has bent ends.

21. The tool of claim 12, wherein the construction of the tool and the box like housing result in the box like housing having at least a front wall, bottom wall, back wall, and two side walls that each have completely smooth inner surfaces without any mounting holes or attachment means protruding therein so that a seal on the moveable plate does not contact or cross any discontinuities and, therefore, will not be torn or worn during use.

22. A drywall tool for applying mastic, comprising:

a flexible blade holder that is preformed in an arched shape and having a non-uniform flex profile that varies along its lateral length so that at various flexing pressure(s) the flexible blade holder flexes in a convex and concave shape simultaneously along its lateral length.

23. The drywall tool of claim 22, wherein the blade holder has a non-uniform cross-sectional geometry along its lateral length and includes at least one of the following features: a preformed bowed lateral length, an angled blade channel, ribs in the blade channel, a lateral wall in thinner areas of the lateral length, outermost ends that are bigger in cross-section than the cross-section of the lateral length, outermost ends with strengthening members for strengthening the outermost ends against breaking and bending, or a blade mounted in the blade holder.

24. The drywall tool of claim 23, further comprising:

a housing including a front wall, a bottom wall, and a back wall, wherein at least one of these walls has at least one approximately semicircular, three quarter circular, or cylindrical shape formed therein that is tapped on both opposing far ends so that a screw may be screwed into the tapped portion to hold a plurality of side walls thereto, wherein the inner surfaces of the walls are smooth and free of holes and attachment means;

a moveable plate or wall with a seal on at least three sides and held at one end to the back wall in an approximately semicircular to approximately three quarter circular shaped channel formed in the back wall;

an elongated bushing having an elongated slot or slit formed in it to place one edge of the moveable plate therein so as to form a sealed hinged design for the movable plate;

a blade adjustment system including at least one tapered leaf spring, at least one symmetrical fixed length post that is reversible in assembly, a mounting bracket, a knob for turning to vary tension on the blade, wherein the mounting bracket is mounted to an integrally formed mounting shelf of a front wall of the box like housing and the knob is mounted between the front wall and the mounting bracket but supported only by the mounting bracket, such that no holes are made through the front wall into the interior of the box like housing;

a quick release single piece end guide or skid plate attaching the blade holder to the housing;

wherein the front wall of the housing is a single piece front wall including a blade assembly channel and an adjustment system mounting shelf; and wherein at least one of the front wall, bottom wall, and back wall of the housing has at least one three quarter circular screw mount channel integrally formed therein.

* * * * *